US006942953B2

(12) United States Patent
Serizawa et al.

(10) Patent No.: US 6,942,953 B2
(45) Date of Patent: Sep. 13, 2005

(54) IMAGE FORMING METHOD

(75) Inventors: Manabu Serizawa, Minamiashigara (JP); Hidekazu Yaguchi, Minamiashigara (JP); Tsutomu Kubo, Minamiashigara (JP); Hiroyuki Tanaka, Minamiashigara (JP); Shigeru Seitoku, Minamiashigara (JP); Kazuhiko Yanagida, Minamiashigara (JP); Yasuo Matsumura, Minamiashigara (JP); Shuji Sato, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/736,609

(22) Filed: Dec. 17, 2003

(65) Prior Publication Data

US 2004/0253530 A1 Dec. 16, 2004

(30) Foreign Application Priority Data

Jun. 11, 2003 (JP) ..... 2003-165941

(51) Int. Cl.[7] ..... G03G 13/20
(52) U.S. Cl. ..... 430/124; 430/109.3; 430/111.4
(58) Field of Search ..... 430/124, 111.4, 430/109.3; 399/333

(56) References Cited

U.S. PATENT DOCUMENTS 5,066,558 A * 11/1991 Hikake et al. ..... 430/108.7
5,501,881 A * 3/1996 Fuller et al. ..... 427/427.5
5,968,701 A * 10/1999 Onuma et al. ..... 430/108.22

FOREIGN PATENT DOCUMENTS

| | | |
|---|---|---|
| JP | A 63-282752 | 11/1988 |
| JP | A 6-250439 | 9/1994 |
| JP | B2 3141783 | 12/2000 |

OTHER PUBLICATIONS

Grant, R., et al., ed., *Grant & Hackh's Chemical Dictionary*, 5th edition, McGraw–Hill Book Company, NY (1987), p. 371.*

Neufeldt, V., et al., ed., *Webster's New World Dictionary*, 3rd College Edition, Simon & Schuster, Inc:, NY (1988), p. 1165.*

* cited by examiner

*Primary Examiner*—Janis L. Dote
(74) *Attorney, Agent, or Firm*—Oliff & Berridge, PLC

(57) ABSTRACT

The present invention provides an image forming method comprising the steps of forming an electrostatic latent image on a surface of an electrostatic latent image bearing body, forming a toner image by developing the electrostatic latent image by using a toner, transferring the toner image to the surface of a recording medium, and fusing the transferred toner image on the surface of the recording medium by bringing the toner image into contact with a heating medium, which has a resin coating layer formed on the surface thereof, and thereby melting the toner image. The toner contains a binder resin containing monomers having vinyl double bonds. A storage elasticity of the toner at 180° C. is in a range of $1\times10^3$ to $8\times10^3$ Pa and a contact angle of the surface of the heating medium to water at 25° C. is in a range of 50 to 100°.

11 Claims, No Drawings

IMAGE FORMING METHOD

CROSS-REFERENCE TO RELATED APPLICATIONS

This application claims benefit of and priority to Japanese Patent Application No. 2003-165941, filed on Jun. 11, 2003, which is incorporated herein by reference in its entirety for all purposes.

BACKGROUND OF THE INVENTION

1.Field of the Invention

The present invention relates to an image forming method for visualizing an electrostatic latent image formed by electrophotography, electrostatic recording or the like and providing a high quality image by subjecting the electrostatic latent image to the respective steps of development, transfer, and fusing.

2. Description of the Related Art

Like an electrophotographic method, a method for visualizing image information through an electrostatic latent image is being applied widely in a variety of fields at present. With respect to the electrophotographic method, an electrostatic latent image on a surface of a photoreceptor is subjected to a charge process and an exposure process to be developed by a toner for electrostatic latent image development (hereinafter, sometimes referred to as toner) and then subjected to transfer process, fusing process and the like to visualize the electrostatic latent image.

As a developer to be used in such a method, a two-component developer composed of a toner and a carrier and a monocomponent developer using a single magnetic toner or a non-magnetic toner are known. As a production method of a toner to be used for such developers, there is a kneading-pulverizing process comprising melting and kneading, a regular thermoplastic resin, with a pigment, a releasing agent, a charge controlling agent and the like, cooling the mixture, and pulverizing and classifying to obtain a desired particle size.

Further, if necessary, an inorganic or organic fine particle may sometimes be added to the surface of such a toner subjected to the pulverization and classification in order to improve the fluidity and cleaning properties thereof.

In a regular kneading-pulverizing process, the shape and the surface structure of the toner are amorphous and depending on the pulverable property of a material to be used and the conditions of the pulverization process, these properties might change slightly, making it difficult to intentionally control the shape and the surface structure of the toner. Further, in the above-mentioned kneading-pulverizing process, selection of a material usable for toner production is limited. Particularly, in the case of a material with a high pulverability, due to mechanical forces in a developing unit, generation of ultrafine powders or toner shape changes often take place.

Due to such effects, in a two-component developer, charge deterioration of the developer is accelerated by adhesion of the generated ultrafine powder to the carrier surface or in a monocomponent developer, toner scattering occurs because of the wide particle size distribution or the developing capability is decreased because of the toner shape alteration, resulting in easy deterioration of the image quality.

Further, when a releasing agent such as a wax is added to produce a toner, depending on the combination with a thermoplastic resin, exposure of the releasing agent to the toner surface often becomes a problem. In the case of combination of a resin, which is provided with elasticity from a polymer component and thus is slightly hard to pulverize, with a fragile wax releasing agent such as polyethylene, exposure of polyethylene to the toner surface is often observed. Although such a phenomenon is advantageous for the releasing property thereof at the time of fusing and the cleaning of the non-transferred toner from the surface of a photoreceptor (an electrostatic latent image bearing body), the polyethylene in the surface layer is easily moved by the mechanical force to cause stains on a development roll, the photoreceptor, or the carrier, with the result that the reliability may be lowered.

Since the toner shape is amorphous, even if a fluidizing agent is added, the fluidity is not sufficient and the ultrafine particle on the toner surface are moved to recessed parts by the mechanical force during use. Accordingly, the fluidity decreases over of time and the fluidizing agent is buried in the inside of the toner to result in problems such as deterioration of the development property, transfer property, and cleaning property.

Recently, as a method for intentionally controlling the shape and the surface structure of the toner, toner production methods by emulsion-polymerization aggregation processes have been proposed (e.g., Japanese Patent Application Laid-Open (JP-A) Nos. 63-282752 and 6-250439).

The above-mentioned emulsion-polymerization aggregation processes can efficiently produce small-sized toners with small sizes since finely granulated raw materials of generally 1 $\mu$m or smaller are used as starting substances. To describe more in details, in general, the methods comprise: producing resin dispersions by emulsion polymerization, and producing coloring agent dispersions containing coloring agents in solvents, mixing these resin dispersions and the coloring agent dispersions and forming flocculate particles with sizes corresponding to toner particle sizes, and after that, coalescence the flocculate particles by heating to produce toners. However, these methods generally produce toners with the same compositions of the surface and initially, so that it is difficult to intentionally control the surface compositions.

Regarding such a problem, means for carrying out more precise particle structure control by freely controlling surface layers from inner layers of even toners to be produced by emulsion-polymerization aggregation processes have been proposed (e.g., Japanese Patent No. 3,141,783). Since it is made easy to make the toner sizes be small and it is made possible to precisely control particle structure, conventional electrophotographic images have been improved remarkably in the qualities and provided also with high reliability.

From the viewpoint of recent digital mechanization and improvement of productivity of office documentation, in order to respond to regulates for higher speeds and energy savings, further low temperature fusing is required. From this view point, the toners produced by the above-mentioned emulsion-polymerization aggregation process are advantageous since they have narrow particle size distributions and can be made smaller sized.

In addition to the above-mentioned low temperature fusing property, in order to ensure a releasing property at the time of fusing, a method for lowering a surface energy of a heating medium by coating a fluorine-containing resin on a surface of a heating medium such as a fusing roll has generally been employed.

However, when a heating medium having a surface thereof coated with a resin, for example, on the surface is heated by a heating source embedded in inside the heavy medium, since the resin generally has a low thermal conductivity as compared with metal, a temperature difference between the surface and the inside of the heating medium is easily caused. Such a tendency becomes more significant as the resin thickness becomes thicker and in this case, not only it becomes difficult to deal with the energy saving requirement, but also the adhesiveness of the fluorine-containing resin to the heating medium tends to decrease easily, and therefore the life as a heating medium is shortened.

Contrarily, in the case the resin film on the surface of the heating medium is made thin, the above-mentioned fluorine-containing resin coating is easily worn out, making it difficult to stably maintain the low energy of the surface of the heating medium for a long term.

Due to the above-mentioned situation, it is desired to develop an image forming method with a higher degree of freedom regarding the surface energy fluctuation in the surfaces of respective members to be brought into contact with a toner image on a recording medium surface.

SUMMARY OF THE INVENTION

The present invention has an object to solve the above-mentioned problems of prior art.

That is, the object of the invention is to widen the option of materials usable for the above-mentioned coating resin and improve the low temperature fusing and retention of the heating medium while keeping the releasing property of a toner from a resin coating on the surface of a heating medium at fusing.

The above-mentioned object can be achieved by the invention as follows. That is, one aspect of the invention provides an image forming method comprising the steps of:

forming an electrostatic latent image on a surface of an electrostatic latent image bearing body;

forming a toner image by developing the electrostatic latent image by using a toner for electrostatic latent image development;

transferring the toner image to a surface of a recording medium; and fusing the transferred toner image on the surface of the recording medium by bringing the toner image into contact with a heating medium having a resin coating layer formed on the surface thereof and thereby melting the toner image, wherein the toner for the electrostatic latent image development includes a binder resin obtained by polymerizing at least one kind of polymerizable monomers having vinyl double bonds;

a storage elasticity G'(180) of the toner for electrostatic latent image development at 180° C. is in a range of $1\times10^3$ to $8\times10^3$ Pa; and a contact angle of the surface of the heating medium to water at 25° C. is in a range of 50 to 100°.

A preferable aspect of the invention provides an image forming method, wherein the toner for electrostatic latent image development contains external additives formed from single substances or mixtures having at least two different average particle sizes, wherein at least one of the external additives is a metal oxide having an average particle size of 0.03 $\mu$m or less.

Another preferable aspect of the invention is the image forming method, wherein a resin included in the resin coating layer is a heat-curable resin.

Another preferable aspect of the invention is the image forming method, wherein the toner for electrostatic latent image development includes a releasing agent in an amount of 1 to 40% by weight and a melting point of the releasing agent is in a range of 40 to 100° C.

Further, for the toner for electrostatic latent image development, it is preferable to use a toner particle produced by a method comprising the steps of: mixing at least a resin particle dispersion containing resin particles having a particle size of 1 $\mu$m or less and a coloring agent dispersion containing particles of the coloring agent; flocculating the resin particles and the particles of the coloring agent to obtain flocculates having a toner particle diameter size; and heating the flocculates to a temperature equal to or higher than the glass transition point of the resin to coalescence the flocculates and thus obtain the toner particles.

Another preferable aspect of the invention provides an image forming method, wherein a volume average particle size of the toner for electrostatic latent image development is in a range of 4 to 10 $\mu$m, and at least one kind of the polymerizable monomers having vinyl double bonds are polymerizable monomers having carboxyl groups.

DETAILED DESCRIPTION OF THE INVENTION

Hereinafter, the present invention will be described more in details.

An image forming method of the invention comprises a step of fusing the transferred toner image on the surface of the recording medium by bringing the toner image into contact with a heating medium having a resin coating layer formed on the surface thereof and thereby melting the toner image, and is characterized in that a storage elasticity of the toner for electrostatic latent image development at 180° C. [G'(180)] is in a range of $1\times10^3$ to $8\times10^3$ Pa; and a contact angle of the surface of the heating medium to water at 25° C. is in a range of 50 to 100°.

Use of a toner having a proper storage elasticity even at a high temperature and a heating medium coated with resin having a proper surface energy in the fusing step makes image formation with excellent releasing property possible.

That is, since highly flocculating force can be generated among binder resin molecules contained in the toner during the melting of the toner if the storage elasticity [G'(180)] is controlled to be in a range of $1\times10^3$ to $8\times10^3$ Pa and a heating medium having the contact angle of the surface to water at 25° C. in a range of 50 to 100° is used, fusing can be carried out without causing off-set. Further, since the resin in the surface of the heating medium has a proper surface energy, both of high adhesiveness to a substrate of the heating medium and high abrasion resistance can be provided and accordingly, an image forming method with a wide fusing temperature range and a prolonged life of a heating medium can be provided.

In general, a toner (a toner image) transferred to the surface of a recording medium through charging process, exposing process, and transferring process is melted by being brought into contact with a heating medium such as a fusing roll or the like and penetrates the recording medium to be fused thereby in fusing process. The heat from the heating medium is used for melting the toner and simultaneously for heating the recording medium and especially, in high temperature and high humidity conditions just like summer environments or the like, the heat is also used for evaporating water contained in the recording medium, the quantity of the heat to be consumed for melting the toner is consequently decreased to result in easy occurrence of off-set.

To deal with that, it is required either to increase the temperature of the heating medium or lower the speed of the process, however the former manner cannot be satisfactory for saving energy and prolonging the life of the heating medium and the latter manner cannot be satisfactory for increasing the speed as described above.

Therefore, in the invention, the temperature difference between the surface and the inside of the heating medium is narrowed as much as possible and at the same time, the surface of the heating medium is coated with the resin having a proper surface energy to improve the adhesiveness to the heating medium and on the other hand, the storage elasticity [G'(180)] of the toner at 180° C. is controlled to be in a predetermined range to keep the aggregation force of the binder resin contained in the toner, so that the fusing can be carried out without using a resin with an extremely low surface energy for the surface of the heating medium and based on these findings, the invention is completed.

Heating Medium

Hereinafter, a heating medium for a toner in the invention will be described.

A heating medium to be used in the invention is not particularly limited and those with roll-like shapes and belt-like shapes maybe employed without any limitation if their surfaces bear resin coatings (that is, their surfaces are coated with resins) so as to have contact angles of their surfaces to water at 25° C. in a range of 50 to 100°. In general, the heating medium has a basic structure comprising such as a hollow metal roll and a heat radiation lamp disposed in the inside; a thermocouple with a high resistance installed in the surface of a metal roll or in the periphery of the surface; or the like for generating heat by electric power application. In many cases, the metal roll surface is oxidized and has high polarity.

For the metal roll, materials such as a stainless steel and the like with low polarity can be used as they are, however the materials such as a binder resin, a pigment, a charge controlling agent and the like having polar groups are easily transferred to the metal roll surface by contact with the toner perticles at the time of fusing and off-set tends to be caused easily.

The off-set can be improved by decreasing the amount of the polar groups in the metal roll surface. As a method for that, coating the surface with a fluorine-containing polymer such as polytetrafluoroethylene, poly(vinylidene fluoride), or the like can be exemplified, however, such a polymer is inferior in the adhesiveness to the metal surface and is therefore easily peeled off by the use for a long period or decomposed in high temperature conditions. Further, in the case of silicone type resins, which are heat-curable resins and have low surface energy, generally, they are not only easily worn out owing to the low hardness but also easily scratched and the roll surface is deformed with the lapse of time owing to high adhesiveness to silica used usually as an external additive for a toner.

To solve these problems, in the invention, a resin having a proper surface energy is used for the surface of the heating medium. In this case, the adhesiveness to the surface of the heating medium can be improved and at the same time, the adhesiveness to the toner in the melted state can be decreased to a certain extent and moreover, the adhesiveness between the toner and the surface of the heating medium can be decreased by using a toner that will be described later, so that the temperature range in which the fusing is carried out can be widened.

As described above, in the invention, the contact angle of the surface of the heating medium to water at 25° C. is required to be in a range of 50 to 100° and the contact angle is preferably in a range of 60 to 100°, more preferably in a range of 70 to 100°. A method and conditions for measuring the contact angle will be described later.

In the case the contact angle of the surface of the heating medium to water is less than 50°, the polarity of the resin surface is high and the adhesiveness to the toner is increased at the time of fusing, so that off-set is easily caused and in the case it exceeds 100°, the resin on the surface of the heating medium is easily peeled off and therefore it is not preferable.

The contact angle of the surface of the heating medium means an initial contact angle in the case of formation of a resin coating layer and it is desirable that the fluctuation of the contact angle during the use of the heating medium is slight. In the invention, the fluctuation of the contact angle in the case the heating medium is used for an image forming apparatus is preferably in a range of 0 to 10° after 10,000 times repeated image formation using, for example, A4-size recording media and more preferably in a range of 0 to 5°.

Specific examples of the resin usable for the surface of the heating medium in the invention include hydrocarbon type resins such as polyethylene, polypropylene, polystyrene; halogen-containing resins such as polyvinyl chloride, polyvinylidene chloride, polyvinyl fluoride, polyvinylidene fluoride; oxygen-containing resins such as polyvinyl alcohol, phenol resins, polyvinyl ethers, polyvinyl formal, polyvinyl butyral, acetophenone resins, cyclohexanone resins, ketone resins, polyacetal resins, polyethylene oxide, polyether ether ketones, polycarbonates, polyacrylates, polyethylene terephthalate, phenoxy resins; acrylic polymers such as polymethyl acrylate, polymethyl methacrylate; sulfur-containing resins such as phenylene sulfide resins, Udel polysulfones, polyether sulfones, polyamine sulfones; nitrogen-containing resins such as melamine resins; silicone resins; and the like.

They may be used alone or in form of a mixture of two or more. Further, the above-mentioned various resins may be modified by reactive polymerizable monomers and polymers.

In the case of coating the surface of the heating medium, the coating layer may be formed into a single layer structure or a structure composed of a plurality of layers.

Among these resins, phenol resins, melamine resins, silicone resins, and acrylic resins are preferable for the coating resins in the invention from the viewpoint of the easiness of peeling-off of an un-fused toner layer and adhesiveness to the resin of the heating medium and heat-curable resins such as phenol resins and melamine resins are particularly preferable to be used since the heating medium is heated to a temperature as high as 200° C. or higher.

The thickness of a resin coating layer on the surface of the heating medium using such resins is preferably in a range of about 1 to 100 μm, more preferably in a range of 5 to 50 μm, and furthermore preferably in a range of 10 to 40 μm from the viewpoint of handling easiness.

If the thickness of the resin coating layer is thinner than 1 μm, there may occur a problem in abrasion resistance and if it is thicker than 100 μm, the temperature difference is easily generated by the heat of the heating medium and therefore the resin coating layer is cracked or deformed to result in undesirable consequence.

Toner for Electrostatic Latent Image Development

Next, a toner for electrostatic latent image development to be used for an image forming method of the invention will be described.

A toner image obtained through transfer process is fused on a heated recording medium in fusing process. The viscoelasticity of the toner forming the toner image in this case greatly affects the fusing properties and under a low temperature condition where the viscosity is high, the toner is not fused on the surface of a recording medium and adheres to a heating roll (a heating medium) and the adhering toner is fused in a tail side of the recording medium by one circumference of the roll in the recording medium passing direction in a fusing device, that is, so-called low temperature off-set is caused. Further, in a high temperature range where the viscosity is low, the toner is cut in the insides of toner particle layers at the time of fusing and one fragments go to the recording medium and separately the other fragments go to the heating roll and the toner fragments moved to the heating roll side are fused in the tail side of the recording medium by one circumference of the roll to cause high temperature off-set similarly to the above-mentioned low temperature off-set.

In order to prevent occurrence of the above-mentioned low temperature and high temperature off-set, a low surface energy layer of such as a fluoro resin or a silicone resin is formed on the surface of the heating roll and the formation is effective to prevent the occurrence of off-set, however a low surface energy substance as described above tends to shorten the life of the roll and therefore is not preferable from the viewpoint of the durability and stability.

In the invention, to solve the above-mentioned problems, the viscoelasticity, more specifically the storage elasticity [G'(180)] at 180° C., of a binder resin composing the toner is investigated, with the result that it is found that if [G'(180)] is in a range of $1\times10^3$ to $8\times10^3$ Pa, the low temperature off-set can be prevented since the melting state of the toner can be maintained in a low temperature side and also the high temperature off-set can be prevented since the viscoelasticity of the binder resin contained in the toner can be kept high to a certain degree even in high temperature state.

Since it is made possible to use heat-curable resins other than the above-mentioned fluoro resin and silicone resin as the resin for coating the surface of the heating medium by controlling the storage elasticity [G'(180)] of the toner at 180° C. as described above in the invention, in the case of using a conventional fluoro resin type resin coating layer, a silicone rubber layer formed under the resin coating layer is made no need and from this point of view, durability improvement and cost down of the heating medium can be achieved.

The above-mentioned [G'(180)] is preferably in a range of $1.5\times10^3$ to $8\times10^3$ Pa, more preferably in a range of $3.0\times10^3$ to $8\times10^3$ Pa, since the peeling property of the toner from the heating medium can be maintained.

If [G'(180)] is less than $1\times10^3$ Pa, the viscosity is decreased in the high temperature side and therefore high temperature off-set tends to be easily caused and if [G'(180)] exceeds $8\times10^3$ Pa, fusing becomes difficult in the low temperature side and in both cases, the temperature range for fusing is adversely narrowed.

Incidentally, the above-mentioned storage elasticity G' is measured by a viscoelasticity measurement apparatus (trade name: ARES, manufactured by Rheometric Scientific FE. Ltd.) The measurement sample and measurement conditions will be described later.

Preferable [G'(180)] of the toner for electrostatic latent image development to be used for the image forming method of the invention can be obtained by adjusting mainly the molecular weight of the binder resin. For example, if the weight average molecular weight of the binder resin is in a range of 100,000 to 1,000,000, the aggregation degree of the intermolecules of the resin is increased and it is preferable for fusing. The above-mentioned weight average molecular weight is more preferably in a range of 150,000 to 500,000.

Further, in order to keep the storage elasticity slightly high in melted state of the toner at a relatively high temperature, it is also required to keep the molecular weight distribution in a predetermined range. As the molecular weight distribution of the binder resin in the invention, a ratio (Mw/Mn) of a weight average molecular weight Mw and a number average molecular weight Mn of the binder resin is preferably in a range of 5 to 40, and more preferably in a range of 5 to 10.

Generally, the molecular weight is adjusted by an amount of a polymerization initiator, an amount of a chain transfer agent, and a polymerization temperature at the time of polymerization and it is increased by means of decreasing the amount of the polymerization initiator, the amount of the chain transfer agent, and lowering the polymerization temperature. In order to provide the binder resin with [G'(180)] in the required range, a single type of polymerizable monomers may be polymerized to obtain the binder or a resin with a molecular weight of several ten thousands and a resin with a molecular weight of million or higher may be mixed at a proper ratio to obtain the binder. In general, the resin obtained by the latter method is preferable since the fusing temperature range can be widened.

Further, a cross-linking agent may be added at the time of polymerization and intermolecular cross-linking is caused to keep [G'(180)] in the required range. The addition of the cross-linking agent and molecular weight adjustment may be combined.

In the case the toner is produced particularly by an emulsion-aggregation coalescence process, [G'(180)] of the binder resin can be increased by adding a flocculant which will be described later. Generally, a metal ion contained in the flocculant is effective to attract and flocculate the particles at the time of aggregation and such tendency is higher and the aggregation power is stronger as the valence of the metal ion is higher. For that, the flocculant is supposed to increase [G'(180)].

In the invention, as the binder resin for the toner, it is required to use those obtained by polymerizing one or more polymerizable monomers having vinyl double bonds. Generally, since binder resins obtained by polymerizing polymerizable monomers having vinyl double bonds show hardness and insensitive response to heat as compared with condensation type resins such as polyesters, epoxy resins, urethanes and the like, they are preferable for a fusing device for the invention in which a heating roll has a thin thickness and the surface temperature is easily changed. Further, in general, the resins have low polarity, as compared with conventional fluorine-containing or silicone resins, they are advantageous in the case of using a fusing roll with high surface energy.

Further, in the invention, it is preferable that at least one kind of the polymerizable monomers having vinyl double bonds are polymerizable monomers having carboxyl groups. Carboxyl group provides the resin with polarity and improves the effect of the flocculant and the existence of carboxyl group in the resin obtained by polymerization, therefore, makes it possible to decrease the addition amount of the flocculant, narrow the particle size distribution of the flocculated particles and produce the toner with scarce ultrafine powder generation.

Specific examples of the resins obtained by polymerizing the polymerizable monomers having vinyl double bonds are homopolymes or copolymers (styrene type resins) of styrene, p-chlorostyrene, α-methylstyrene; homopolymes or copolymers (vinyl type resins) of vinyl group-containing esters such as methyl acrylates, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate; homopolymes or copolymers (vinyl type resins) of vinylnitriles such as acrylonitrile and methacrylonitrile; homopolymes or copolymers (vinyl type resins) of vinyl ethers such as vinyl methyl ether and vinyl isobutyl ether; homopolymes or copolymers (vinyl type resins) of ketones such as vinyl methyl ketone, vinyl ethyl ketone, and vinyl isopropenyl ketone; and homopolymes or copolymers (olefin type resins) of olefins such as ethylene, propylene, butadiene, and isoprene.

These resins may be used alone or in combination of two or more.

If the above-mentioned resins are used as the binder resin, other resins may be used in combination. Those resins are not particularly limited and specific examples include silicone resins obtained by polymerizing methylsilicone, methylphenylsiliones; polyesters containing bisphenol, glycol and the like; epoxy resins, polyurethane resins, polyamide resins, cellulose resins, polyether resins, and polycarbonate resins.

The ratios of these resins to the resins obtained by polymerizing the polymerizable monomers having vinyl double bonds are preferably in a range of 0 to 50% by weight, more preferably in a range of 1 to 30% by weight, and furthermore preferably in a range of 2 to 20% by weight.

If the above-mentioned ratios exceed 50% by weight, the effect of the resins obtained by polymerizing the polymerizable monomers having vinyl double bonds is diminished and no effect of the invention can be obtained in some cases.

A method for producing a toner for electrostatic latent image development to be used for the image forming method of the invention is not particularly limited if the method is capable of forming particles and a particularly preferable method is an emulsion-polymerization aggregation process. The emulsion-polymerization aggregation process comprises the process of mixing at least a resin particle dispersion containing a resin particle having 1 μm or smaller particle size and a coloring agent dispersion containing a coloring agent and flocculating the resin particle and the coloring agent into a toner particle size (hereinafter, referred to as flocculating process in some cases), and the process of coalescence the resulting flocculate particles by heating them to a temperature equal to or higher than the glass transition point of the resin and forming coloring toner particle (hereinafter, referred to as coalescence process in some cases).

In the above-mentioned flocculating process, the resin particles contained in the resin particle dispersion, the coloring agent dispersion, and if necessary, a releasing agent dispersion are flocculated to form flocculated particles. The flocculated particles are formed by hetero-aggregation and in order to stabilize the flocculated particles and control the particle size/particle size distribution, an ionic surfactant with different polarity to that of the resin particles or a compound such as a metal salt having mono- or higher valence is added to form the particles.

In the above-mentioned coalescence process, the resin in the flocculated particles is melted in a condition of a temperature equal to or higher than the glass transition point and the flocculated particles are changed from amorphous to spherical state. In this case, flocculated particles with a shape factor SF1 of 150 or higher become smaller as they become spherical and the shape factor can be controlled by stopping the heating of the toner when the shape factor SF1 reaches a desired value. After that, the flocculated substance is separated from water-based solvent and, if necessary, subjected to washing and drying to obtain a toner.

The above-mentioned shape factor SF1 can be calculated according to the following equation (1).

$$SF1=(ML^2/A)\times(\pi/4)\times 100 \qquad \text{Equation (1)}$$

In the equation (1), ML denotes the absolute longest length of toner particles and A denotes the projected surface area of the toner particles, respectively.

The above-mentioned SF1 can be made numerical by analyzing mainly a microscopic image or a scanning electromicroscopic (SEM) image by a microscope image analysis system and can be calculated, for example, as follows. That is, the SF1 can be calculated by taking an optical microscopic image of the toner sprayed to a slide glass surface in a LUZEX microscope image analysis system through a video camera; measuring the longest length and the projected surface area of 100 or more toner particles; carrying out calculation according to the above-mentioned equation (1) from these values; and calculating the average value.

In general, off-set is more easily caused if the toner becomes more spherical and in the invention, from the viewpoint of both image quality and off-set resistance, the final shape factor SF1 of the toner is preferably in a range of 115 to 140, more preferably in a range of 120 to 135.

As a production method of the toner for electrostatic latent image development to be used for the image forming method of the invention, a suspension polymerization can also be employed. The suspension polymerization is a method involving; suspending a coloring agent particle, a releasing agent particle and the like together with polymerizable monomers in a water-based medium mixed with a dispersion stabilizer or the like, if necessary; dispersing them to have desired particle sizes and particle size distribution; polymerizing the polymerizable monomers by means of heating or the like; separating the polymers from the water-based medium after the polymerization; and subjecting the polymers to washing and drying if necessary to form a toner.

As the coloring agent to be used for the toner for electrostatic latent image development in the invention, it is preferable to contain at least one kind of pigment selected from Cyane, Magenta, Yellow, and Black pigments and they may be used alone or in form of mixtures of two or more pigments of the similar color types. Two or more pigments of different color types may also be used.

Examples of the above-mentioned coloring agents are various pigments such as Chrome Yellow, Hansa Yellow, Benzidine Yellow, Threne Yellow, Quinoline Yellow, Permanent Orange GTR, Pyrazolone Orange, Vulcan Orange, Watchung Red, Permanent Red, Brilliant Carmine 3B, Brilliant Carmine 6B, Du Pont Oil Red, Pyrazolone Red, Lithol Red, Rhodamine B Lake, Lake Red C, Rose Bengal, Aniline Blue, Ultramarine Blue, Calco Oil Blue, Methylene Blue Chloride, Phthalocyanine Blue, Phthalocyanine Green, Malachite Green Oxalate, Furnace Black, Channel Black, Acetylene Black, Thermal Black, Lamp Black; and various types of dyes such as acridine types, xanthene types, azo types, benzoquinone types, azine types, anthraquinone types, dioxazine types, thiazine types, azomethine types, indigo types, thioindigo types, phthalocyanine types, aniline black types, polymethine types, triphenylmethane types, diphenylmethane types, thiazole types, xanthene types.

In the production of the toner for electrostatic latent image development to be used for the invention, a surfactant may be used for the purpose for stabilization at the time of dispersion in the suspension polymerization or for dispersion stabilization of the resin particle dispersion, the coloring agent dispersion, and the releasing agent dispersion in the emulsion-polymerization aggregation process.

Examples of the surfactant include anionic surfactants such as sulfuric acid ester types, sulfonic acid types, phosphoric acid ester types, soap; cationic surfactants such as amine salt types, quaternary ammonium salt types; and non-ionic surfactants such as polyethylene glycol types, alkylphenol ethylene oxide adduct types, polyalcohol types. Ionic surfactants are preferable among them and anionic surfactants and cationic surfactants are more preferable.

With respect to the production of the toner of the invention, generally, the anionic surfactants have a high dispersing capability and excellent in the dispersing function to resin particles and coloring agents and therefore, cationic surfactants are advantageous for the surfactant for dispersing the releasing agents. Further, the non-ionic surfactants are preferably used in combination with the anionic surfactants or cationic surfactants. The surfactants may be used alone or in combination of two or more.

Specific examples of the anionic surfactants are fatty acid soaps such as potassium laurate, sodium oleate, and castor oil sodium salt; sulfuric acid esters such as octyl sulfate, lauryl sulfate, lauryl ether sulfate, and nonyl phenyl ether sulfate; sulfonic acid salts such as lauryl sulfonate, dodecylbenzene sulfonate, alkylnaphthalene sulfonate, e.g., triisopropylnaphthalene sulfonate and dibutylnaphthalene sulfonate and their sodium salts, napthalene sulfonate formaline condensates, monoocyl sulfosuccinate, dioctyl sulfosuccinate, lauric acid amide sulfonate, and oleic acid amide sulfonate; phosphoric acid esters such as lauryl phosphate, isopropyl phosphate, and nonyl phenyl ether phosphate; dialkylsulfosuccinic acid salts such as sodium dioctylsulfosuccinate; and sulfosuccinic acid salts such as lauryl sulfosuccinate disodium salt.

Specific examples of the cationic surfactants are amine salts such as laurylamine hydrochloric acid salt, stearylamine hydrochloric acid salt, oleylamine acetic acid salt, stearylamine acetic acid salt, and stearylaminopropylamine acetic acid salt; and quaternary ammonium salts such as lauryltrimethylammonium chloride, dilauryldimethylammonium chloride, distearyldimethylammonium chloride, distearyldimethylammonium chloride, lauryldihydroxyethylmethylammonium chloride, oleylbis(polyoxyethylene) methylammonium chloride, lauroylaminopropyldimethylethylammonium ethosulfate, lauroylaminopropyldimethylhydroxyethylammonium perchlorate, alkylbenzenetrimethylammonium chloride, and alkyltrimethylammonium chloride.

Specific examples of the non-ionic surfactants are alkyl ethers such as polyoxyethylene octyl ether, polyoxyethylene lauryl ether, polyoxyethylene stearyl ether, and polyoxyethylene oleyl ether; alkyl phenyl ethers such as polyoxyethyleneoctyl phenyl ether and polyoxyethylenenonyl phenyl ether; alkyl esters such as polyoxyethylene laurate, polyoxyethylene stearate, and polyoxyethylene oleate; alkylamines such as polyoxyethylenelaurylamino ether, polyoxyethylenestearylamino ether, polyoxyethyleneoleylamino ether, polyoxyethylene soybean amino ether, and polyoxyethylene beef tallow amino ether; alkylamides such as polyoxyethylenelauric acid amide, polyoxyethylenestearic acid amide, and polyoxyethyleneoleic acid amide; plant oil ethers such as polyoxyethylene castor oil ether and polyoxyethylene rapeseed oil ether; alkanolamides such as lauryl acid diethanolamide, stearic acid diethanolamide, and oleic acid diethanol amide; and sorbitan ester ethers such as polyoxyethylenesorbitan monolaurate, poloxyethylenesorbitan monopalmitate, polyoxyethylenesorbitan monostearate, and polyoxyethyelnesorbitan monooleate.

The content of the surfactants in the respective dispersions may be optional unless they do not interfere the invention and generally is a slight amount and practically it is about 0.01 to 10% by weight, more preferably about 0.05 to 5% by weight and furthermore preferably 0.1 to 2% by weight. If the content is less than 0.01% by weight, the respective dispersions such as the resin particle dispersion, the coloring agent dispersion, and the releasing agent dispersion become unstable and therefore cause aggregation or since the stability differs in the interparticles at the time aggregation, particles with predetermined particle size are isolated and if it exceeds 10% by weight, the particle size distribution of the particles becomes broad and it becomes difficult to control the particle diameter and because of such reasons, it is not preferable. Generally, a suspension polymerization toner dispersion with a large particle diameter is stable with a small amount of the surfactants to be used.

As a dispersion stabilizer to be used in the case of the suspension polymerization, inorganic fine powders that are hardly soluble in water and hydrophilic can be used. Examples of usable inorganic fine powders are silica, alumina, titania, calcium carbonate, magnesium carbonate, tricalcium phosphate (hydroxyapatite), clay, diatomaceous earth, bentonite and the like. Above all, calcium carbonate and tricalcium phosphate are preferable from the viewpoint of the easiness of granulation of fine particles and easiness of the removal.

As the dispersion stabilizer, water-base polymer solid at a normal temperature can also be used. Specifically, cellulose type compounds such as carboxymethyl cellulose, hydroxypropyl cellulose, polyvinyl alcohol, gelatin, starch, and gum arabic can be used.

As described above, a cross-linking agent may be added if necessary for the binder resin in the invention.

Specific examples of the cross-linking agent are aromatic polyvinyl compounds such as divinylbenzene and divinylnaphthalene; aromatic polycarboxylic acid polyvinyl esters such as divinyl phthalate, divinyl isophthalate, divinyl terephthalate, divinyl homophthalate, divinyl/trivinyl trimesate, divinyl naphthalenedicarboxylate, and divinyl biphenylcarboxylate; nitrogen-containing aromatic compound divinyl ethers such as divinyl pyridinedicarboxylate; unsaturated heterocyclic compound carboxylic acid vinyl esters such as vinyl pyromucate, vinyl furancarboxylate, vinyl pyrrole-2-carboxylate, and vinyl thiophenecarboxylic acid; straight chain polyalcohol (meth)acrylic acid esters such as butanediol methacrylate, hexanediol acrylate, octanediol methacrylate, decanediol acrylate, and dodecanediol methacrylate; branched or substituted polyalcohol (meth)acrylic acid esters such as neopentylglycol dimethacrylate, and 2-hydroxy-1,3-diacryloxypropane; and polycarboxylic acid polyvinyl esters such as polyethyleneglycol di(meth)acrylate, polypropylene polyethylene glycol di(meth)acrylate, divinyl succinate, divinyl fumarate, vinyl/divinyl maleate, divinyl diglycolate, vinyl/divinyl itaconate, divinyl acetonedicarboxylate, divinyl glutarate, divinyl 3,3'-thiodipropionate, divinyl/trivinyl trans-aconitate, divinyl adipate, divinyl pimelate, divinyl suberate, divinyl azelate, divinyl sebacate, divinyl dedecanedicarboxylate, and divinyl brassylate.

In the invention, these cross-linking agents may be used alone or in combination of two or more.

Among the cross-linking agents, although it depends of the types of other monomers, generally unsaturated fatty acid esters are preferably used. The reason for that is because the reaction of vinyl double bonds is promoted fast as compared with the unsaturated fatty acid esters and therefore, cross-linking sites become uneven in the resin and as a result, a problem that off-set is caused easily in the non-cross-linking parts tends to take place.

Among the cross-linking agents, preferable ones are straight chain polyalcohol (meth)acrylic acid esters such as butanediol methacrylate, hexanediol acrylate, octanediol methacrylate, decanediol acrylate, dodecanediol methacrylate; branched or substituted polyalcohol (meth) acrylic acid esters such as neopentylglycol dimethacrylate, 2-hydroxy-1,3-diacryloxypropane; polyethyleneglycol di(meth) acrylate, polypropylene polyethylene glycol di(meth) acrylate and further preferable ones are straight chain polyalcohol (meth)acrylic acid esters such as butanediol methacrylate, hexanediol acrylate, octanediol methacrylate, decanediol acrylate, dodecanediol methacrylate from the viewpoint of the capability of retaining the uniformity of the reaction.

The resin to be used for the invention can be produced by radical polymerization of polymerizable monomers.

An initiator for the radical polymerization is not particularly limited. Specific examples are peroxides such as hydrogen peroxide, acetyl peroxide, dicumyl peroxide, tert-butyl peroxide, propionyl peroxide, benzoyl peroxide, chlorobenzoyl peroxide, dichlorobenzoyl peroxide, bromomethylbenzoyl peroxide, lauroyl peroxide, ammonium persulfate, sodium persulfate, potassium persulfate, diisopropyl peroxycarbonate, tetralin hydroperoxide, 1-phenyl-2-methylpropyl-1-hydroperoxide, tert-butyl triphenylperacetate hydroperoxide, tert-butyl performate, tert-butyl peracetate, tert-butyl perbenzoate, tert-butyl phenylperacetate, tert-butyl methoxyperacetate, tert-butyl N-(3-tolyl)percarbamate;

azo compounds such as 2,2'-azobispropane, 2,2'-dichloro-2,2'-azobispropane, 1,1'-azo(methylethyl)diacetate, 2,2'-azobis(2-amidinopropane)hydrochloric acid salt, 2,2'-azobis(2-amidinopropane)nitric acid salt, 2,2'-azobisisobutane, 2,2'-azobisisobutylamide, 2,2'-azobisisobutyronitrile, methyl 2,2'-azobis-2-methylpropionate, 2,2'-dichloro-2,2'-azobisbutane, 2,2'-azobis-2-methylbutyronitrile, dimethyl 2,2'-azobisisobutyrate, 1,1'-azobis(sodium 1-methylbutyronitrile-3-sulfonate), 2-(4-methylphenylazo)-2-methylmalonodinitrile, 4,4'-azobis-4-cyanovaleric acid, 3,5-dihydroxymethylphenylazo-2-methylmalonodinitrile, 2-(4-bromophenylazo)-2-allylmalonodinitrile, 2,2'-azobis-2-methylvaleronitrile, dimethyl 4,4'-azobis-4-cyanovalerate, 2,2'-azobis-2,4-dimethylvaleronitrile, 1,1'-azobiscyclohexanenitrile, 2,2'-azobis-2-propylbutyronitrile, 1,1'-azobis-1-chlorophenylethane, 1,1'-azobis-1-cyclohexanecarbonitrile, 1,1'-azobis-1-chloroheptanenitrile, 1,1'-azobis-l-phenylethane, 1,1'-azobiscumene, ethyl 4-nitorphenylazobenzylcyanoacetate, phenylazodiphenylmethane, phenylazotriphenylmethane, 4-nitrophenylazotriphenylmethane, 1,1'-azobis-1,2-diphenylethane, poly (bisphenyl A-4,4'-azobis-4-cyanopentanoate), and poly (tetraethylene glycol-2,2'-azobisisobutyrate) ; 1,4-bis (pentaethylene) -2-tetrazene, 1,4-dimethoxycarbonyl-1,4-diphenyl-2-tetrazene and the like.

The molecular weight adjustment of the resin to be used for the toner of the invention can be carried out using a chain transfer agent. The chain transfer agent is not particularly limited and specifically those having a covalent bond of carbon atom and sulfur atom are preferable and more specific examples are n-alkylmercaptans such as n-propylmercaptan, n-butylmercaptan, n-amylmercaptan, n-hexylmercaptan, n-heptylmercaptan, n-octylmercaptan, n-nonylmercaptan, and n-decylmercaptan; branched chain type alkylmercaptans such as isopropylmercaptan, isobutylmercaptan, sec-butylmercaptan, tert-butylmercaptan, cyclohexylmercaptan, tert-hexadecylmercaptan, tert-laurylmercaptan, tert-nonylmercaptan, tert-octylmercaptan, and tert-tetradecylmercaptan; aromatic ring-containing mercaptans such as allylymercaptan, 3-phenylpropylmercaptan, phenylmercaptan, mercaptotriphenylmethane.

In the production method of the toner in the invention, in the case of employing an emulsion-aggregation coalescence process, aggregation is caused by changing pH in the above-mentioned aggregation process to produce particles. As the same time, a flocculant may be added as a method for stably and quickly carrying out aggregation of the particles or obtaining flocculated particles with a narrower particle size distribution.

As the above-mentioned flocculant, compounds having mono or higher valence and specific examples of the compounds having mono or higher valence are water-soluble surfactants such as the above-mentioned ionic surfactants and non-ionic surfactants; acids such as hydrochloric acid, sulfuric acid, nitric acid, acetic acid, and oxalic acid; inorganic acid metal salts such as magnesium chloride, sodium chloride, aluminum sulfate, calcium sulfate, ammonium sulfate, aluminum nitrate, silver nitrate, copper sulfate, and sodium carbonate, metal salts of fatty acids or aromatic acids such as sodium acetate, potassium formate, sodium oxalate, sodium phthalate, and potassium salicylate; phenol metal salts such as sodium phenolate; and inorganic acid salts of aliphatic or aromatic amines such as aminoacid metal salts, triethanolamine hydrochloric acid salt, and aniline hydrochloric acid salt.

In consideration of stability of the flocculated particles, stability of the flocculant to heat or stability with lapse of time, and removal at the time of cleaning, the inorganic acid metal salts are preferable for use. Specific examples are inorganic acid metal salts such as magnesium chloride, sodium chloride, aluminum sulfate, calcium sulfate, ammonium sulfate, aluminum nitrate, silver nitrate, copper sulfate, and sodium carbonate.

Although the addition amount of these flocculants differs depending on the valence, for any flocculent, a small amount is sufficient and in the case of monovalence, it is about 3% by weight or lower, in the case of divalence, about 1% by weight or lower, and in the case of trivalence, about 0.5% by weight or lower. Since the amount of the flocculants is more preferable to be less and moreover, the above-mentioned [G' (180)] can be controlled more easily if it is less, compounds having higher valence are preferable.

A releasing agent may be added to the toner for electrostatic latent image development in the invention. Addition of the releasing agent makes it possible to release the toner from a fusing part without applying silicone oil or the like to a fusing device and at the same time, since an oil supply apparatus is made no need for the fusing device, the fusing device can be miniaturized and lightweight.

If the releasing agent is used in the emulsion-aggregation coalescence process or the suspension polymerization method, which is a toner production method in the invention, the releasing agent that is generally hydrophobic is entrained in the insides of the particles at the time of flocculating and uniting steps in the emulsion-polymerization aggregation process or at the time of the dispersing step in the suspension polymerization method and therefore, the agent hardly exists in the surface and as described above, a large quantity of carboxyl groups with a high Tg are supposed to exist in the surface and accordingly particle formation is made easy. In a conventional kneading-pulverizing process, a large quantity of releasing agent components exist in the particle surfaces at the time of pulverization and therefore, deposition among particles tends to be easily caused.

Specific examples of the releasing agent are low molecular weight polyolefins such as polyethylene, polypropylene, and polybutene; silicones having softening points by heating; fatty acid amides such as oleic acid amide, erucic acid amide, ricinoleic acid amide, and stearic acid amide; plant type waxes such as carnauba wax, rice wax, candelila wax, crude Japan wax, and jojoba oil; animal type waxes such as bees wax; mineral and petroleum type waxes such as montan wax, ozocerite, ceresine, paraffin wax, microcrystalline wax, and Fisher-Tropsch wax; ester waxes of higher fatty acids and higher alcohols such as stearyl stearate and behenyl behenate; ester waxes of higher fatty acids and mono- or poly-hydric lower alcohols such as butyl stearate, propyl oleate, monostearic acid glyceride, distearic acid glyceride, and pentaerythritol tetrabehenate; ester waxes of higher fatty acid and polyhydric alcohol polymers such as diethyleneglycol monostearate, dipropylene glycol distearate, distearic acid diglyceride, and tetrastearic acid triglyceride; ester waxes of sorbitan higher fatty acids such as sorbitan monostearate; and cholesterol higher fatty acid ester waxes such as cholesteryl stearate.

In the invention, these releasing agents may be used alone or in combination of two or more.

A melting point of the releasing agents is not particularly limited and preferably in a range of 40 to 100° C., more preferably in a range of 50 to 90° C. from the viewpoint of the effect to improve the releasing property. Particularly, in the case of the toner for electrostatic latent image development in the invention, since it has a viscosity in a certain high degree even at a relatively high temperature, in order to bleed a releasing agent to the image surface, it is preferable to use a releasing agent with a low melting point which is melted to a certain extent at a low temperature.

If the melting point of the above-mentioned releasing agent is lower than 40° C., storage property in form of a toner sometimes becomes a problem and if it exceeds 100° C., the bleeding amount of the releasing agent to the toner surface at the time of toner fusing is decreased in some cases to result in occurrence of off-set.

An addition amount of the releasing agent is preferably in a range of 1 to 40% by weight, more preferably in a range of 5 to 40% by weight, and furthermore preferably in a range of 10 to 35% by weight since a sufficient amount of releasing agents can come out to the surface of a heating member.

If the addition amount of the releasing agents is less than 1% by weight, no effect of the releasing agent addition is obtained and if it is 40% by weight or higher, there occur problems that charge property is affected: the toner is easily broken in the inside of a developing unit: the releasing agents are spent for carriers: and that charge property is decreased and therefore, it is not preferable.

The toner for electrostatic latent image development to be used for the image forming method of the invention is preferable to contain a single substance or a mixture having two or more different average particle sizes as an external additive on the surface. Use of the external additive having two or more different particle sizes assures the fluidity of the toner by the external additive with a smaller particle size and at the same time prevents the external additive from being buried in the toner surface and suppresses the fluidity decrease by the external additive with a larger particle size.

With respect to the above-mentioned two or more different average particle sizes, a smaller average particle size is preferably in a range of 5 to 30 nm and more preferably in a range of 7 to 20 nm. A larger average particle size is preferably in a range of 20 to 50 nm and more preferably in a range of 25 to 40 nm.

The above-mentioned external additive is preferable to contain one or more metal oxides. These metal oxides improve the image quality at the time of development based on the effects to improve the fluidity of the toner and make the electric charge property of particles sharp.

Specific examples of the metal oxides are silica, titania, zinc oxide, strontium oxide, aluminum oxide, calcium oxide, magnesium oxide, cerium oxide and their compounded oxides. These metal oxides may be used alone or a plurality of the metal oxides may be used in form of mixtures and silica and titania are preferably used from the viewpoint of the particle size, the particle size distribution, and the productivity.

The addition amount of them to the toner is preferably in a range of 0.1 to 10% by weight, more preferably in a range of 0.2 to 8% by weight, and furthermore preferably in a range of 0.5 to 6% by weight. If the addition amount is less than 0.1% by weight, the effect of the addition of the metal oxides is hardly obtained and the powder fluidity of the toner is deteriorated and therefore, a problem such as blocking in the inside of a developing unit takes place. On the other hand, if it exceeds 10% by weight, since the amount of the free external additive is increased, an intermediate transfer body is more easily worn out and scratched and therefore it is not preferable.

The toner for electrostatic latent image development to be used for the image forming method of the invention preferably contains one or more of external additives formed from single substances or mixtures having at least two different average particle sizes, wherein at least one of the external additives is a metal oxide having an average particle size of 0.03 $\mu$m or less. In general, a metal oxide such as silica and titania is extrapolated to the toner for electrostatic latent image development for the purpose to improve the charge property controllability and fluidity improvement. Particularly, the fluidity significantly affects the toner behavior in the inside of a developing unit and if the fluidity is low, the toner transferring to a development member such as a development roll is deteriorated to result in decrease of the toner density or occurrence of blocking in some cases.

In the case the toner is provided with even fluidity by external additives with different particle sizes, it is natural that the addition amount of the external additive with a larger particle size, which means a smaller specific surface area, is higher and in such a case, when the toner is brought into contact with a heating member in the fusing process, the heating member surface is easily worn out and scratched. Particularly, in the case the toner has a small particle size, a high [G'(180)] value and the external additive has a large particle size, a large amount of the external additive is required to add and therefore, such effects become obvious. For that, the external additive with an average particle size of 0.03 $\mu$m or smaller is added to decrease the addition amount of the external additive to the toner and to suppress the occurrence of the wear and scratches of the fusing roll.

The average particle size of the metal oxides with a smaller particle size is preferably 20 nm or smaller and more preferably 15 nm or smaller. The lower limit is about 5 nm.

These metal oxides may be subjected to surface improvement such as hydrophobic or hydrophilic treatment, if necessary. Conventionally known techniques may be employed for the means of surface improvement. Specifically, coupling treatment for silane, titanate, aluminate and the like may be employed.

A coupling agent for the above-mentioned coupling treatment is not particularly limited and examples preferable to be used are silane coupling agents such as methyltrimethoxysilane, phenyltrimethoxysilane, methylphenyldimethoxysilane, diphenyldimethoxysilane, vinyltrimethoxsilane, γ-aminopropyltrimethoxysilane, γ-chloropropyltrimethoxysilane, γ-bromopropyltrimethoxysilane, γ-glycidoxypropyltrimethoxysilane, γ-mercaptopropyltrimethoxysilane, γ-ureidopropyltrimethoxysilane, fluoroalkyltrimethoxysilane, hexamethylenedisiloxane; titanate coupling agents; aluminate coupling agents and the like.

In the invention, based on the purposes, other than the above-mentioned resin, coloring agents and releasing agents, other components (particles) of such as an internal additive, a charge controlling agent, an organic particle, a lubricating agent, a abrasive and the like may be added to the toner.

The above-mentioned internal additive may be used in an addition amount to an extent that the charge property as a toner characteristic is not interfered and for example, magnetic materials such as ferrite, magnetite, metals and alloys of reduced iron, cobalt, manganese, and nickel, and compounds containing these metals may be used.

The above-mentioned charge controlling agent is not particularly limited and in the case of using a color toner, colorless or pale color agents are preferably used. Examples are quaternary ammonium compounds, Nigrosine type compounds, dyes of complexes of aluminum, iron, and chromium, and triphenylmethane-type pigments.

The above-mentioned organic particle includes, for example, all of the particles, which are usually used as external additives for the toner surface, of such as vinyl resins, polyester resins, and silicone resins. These inorganic particles and organic particles may be used as fluidizing agents, cleaning agents and the like.

As the above-mentioned lubricating agent, fatty acid amides such as ethylene bis (stearic acid amide) , and oleic acid amide; and fatty acid metal salts such as zinc stearate and calcium stearate can be exemplified.

As the above-mentioned abrasive, the above-mentioned silica, alumina, cerium oxide and the like can be exemplified.

The content of a coloring agent in the case the above-mentioned resin, coloring agent and releasing agent are mixed is 50% by weight or less and preferably in a range of 2 to 40% by weight. The content of other components is to an extent that the purpose of the invention is not interfered and generally extremely slight and practically it is preferably in a range of 0.01 to 5% by weight and more preferably in a range of 0.5 to 2% by weight.

Dispersants for the above-mentioned resin particle dispersion, coloring agent dispersion, releasing agent dispersion, and other components in the invention may include, for example, water-based media. Examples of the water-based media are distilled water, ion-exchanged water, alcohols and the like. They may be used alone or in combination of one or more of them.

In the invention, to the surface of the obtained toner for electrostatic latent image development, inorganic particles of such as calcium carbonate and barium sulfate and resin particles of such as vinyl resins, polyester resins, and silicone resins may be added in dry state or by applying shearing force. These inorganic particles and resin particles function as external additives such as fluidizing agents and cleaning assisting agents.

The specific surface area of the toner for electrostatic latent image development of the invention is not particularly limited and it may be in a proper range to use the toner as a usually used toner. Specifically, on the basis of BET specific surface area, it is preferably in a range of 0.5 to 10 $m^2/g$, more preferably in a range of 1.0 to 7 $m^2/g$, and furthermore preferably in a range of 1.2 to 5 $m^2/g$.

The particle size of the toner for electrostatic latent image development of the invention is preferably in a range of 4 to 10 μm on the basis of the volume average particle diameter, more preferably in a range of 4 to 8 μm, and furthermore preferably in a range of 4.5 to 7.5 μm. If the average particle diameter is smaller than 4 μm, since the specific surface area of the toner is increased, the amount of the extrapolating materials to be used is adversely increased. If it exceeds 10 μm, the external additives are buried in the inside of the toner to result in tendency of fluidity deterioration and it is therefore not preferable.

The particle distribution of the toner in the invention can be expressed by particle size distribution index GSD according to the following equation (2):

$$GSD=[(d16/d50)+(d50/d84)]/2. \quad \text{Equation (2)}$$

In the equation, d16, d50, and d84 denote the particle sizes of 16%, 50%, and 84%, respectively, of the toner counted from the large particle size side and the numerical values are in order of d16>d50>d84 and as the GSD is smaller, the toner can be said to have more uniform particle size. The GSD can be calculated on the bases of the number average particle size and on the basis of the volume average particle size and either GSD can be employed for the toner in the invention.

The above-mentioned GSD is preferably 1.3 or smaller, more preferably 1.27 or smaller, and furthermore preferably 1.25 or smaller. If GSD exceeds 1.3, not only the quality of an image is deteriorated, but also ultrafine powder is increased and accordingly, metal oxides remain on the surface of a photoreceptor as described above and therefore, it is not preferable.

The charge of the toner for electrostatic latent image development is preferably in a range of 10 to 40 μC/g by absolute value and more preferably in a range of 15 to 35 μm. If the charge is less than 10 μC/g, the background of the image tends to be stained easily and if it exceeds 40 μC/g, the image density tends to be decreased.

The ratio (charge in summer season/charge in winter season) of the charge of the toner for electrostatic latent image development in a summer season and that in a winter season is preferably in a range of 0.5 to 1.5 and more preferably in a range of 0.7 to 1.3. If the ratio is out of the above-mentioned range, the dependency of the toner on the environments is so high that the toner is insufficient in the stability of the charge property and it is not preferable for practical use.

Electrostatic Latent Image Developer

An electrostatic latent image developer to be used for the invention is not particularly limited except that it contains the above-mentioned toner for electrostatic latent image development and the developer may have a proper component composition depending on the purposes. The electrostatic latent image developer is produced in form of a monocomponent type electrostatic latent image developer if the above-mentioned toner for electrostatic latent image development is used alone and in form of a two-component type electrostatic latent image developer if the toner is used in combination with a carrier.

The above-mentioned carrier is not particularly limited and may include conventionally known carriers and for example, known carriers such as resin-coated carriers described in JP-A Nos. 62-39879 and 56-11461 can be used.

Specific examples of the carrier are the following resin-coated carriers. That is, common iron powder, ferrite, magnetite-forming substances and the like may be exemplified as core particles for the carrier and the average particle size of them is preferably in a range of 30 to 200 $\mu$m.

Examples of the coating resins for the core particles are homopolymers or copolymers of two or more monomers selected from styrenes such as styrene, p-chlorostyrene, and $\alpha$-methylstyrene; $\alpha$-methylene fatty acids and monocarboxylic acids such as methyl acrylate, ethyl acrylate, n-propyl acrylate, lauryl acrylate, 2-ethylhexyl acrylate, methyl methacrylate, methacrylic acid, lauryl n-propylmethacrylate, and 2-ethylhexyl methacrylate; nitrogen-containing acrylic compounds such as dimethylaminoethyl methacrylate; vinylnitriles such as acrylonitrile and methacrylonitrile; vinylpyridines such as 2-vinylpyridine and 4-vinylpyridine; vinyl ethers such as vinyl methyl ether and vinyl isobutyl ether; vinyl ketones such as vinyl methyl ketone, vinyl ethyl ketone, vinyl isopropenyl ketone; olefins such as ethylene and propylene; vinyl fluoromonomer such as vinylidene fluoride, tetrafluoroethylene, and hexafluoroethylene.

Further, the examples include silicones such as methylsilicone and methylphenylsilicone; polyesters containing bisphenol and glycol; epoxy resins; polyurethane resins; polyamide resins; cellulose resins; polyether resins; and polycarbonate resins. These resins may be used alone or in combination of one or more of them.

The amount of the coating resin is preferably in a range of about 0.1 to 10 parts by weight to the core particles and more preferably in a range of 0.5 to 3.0 parts by weight.

For production of the above-mentioned carrier, a heating type kneader, a heating type Henshel mixer, a UM mixer and the like can be employed. Depending on the amount of the coating resin, a heating type fluidized rotary bed and a heating type kiln can be used.

The mixing ratio of the toner for electrostatic latent image development and the carrier in the above-mentioned electrostatic latent image developer is not particularly limited and may properly be adjusted depending on the purposes.

Respective processes in image forming method

As described above, an image forming method of the invention comprises: the process of forming an electrostatic latent image on the surface of an electrostatic latent image bearing body; the process of forming a toner image by developing the electrostatic latent image using a toner for electrostatic latent image development; the process of transferring the toner image on the surface of a transfer object; and process of fusing the transferred toner image on the surface of the recording medium by bringing the toner image into contact with a heating medium at a resin coating layer formed on the surface of the heating medium and thereby melting the toner image and as the toner for electrostatic latent image development and the heating medium, toners and the heating media described above are used.

The image forming method of the invention is preferably applied to an image forming apparatus having a process speed in a range of 100 to 250 mm/sec.

The process of forming an electrostatic latent image is process for forming an electrostatic latent image by evenly charging the surface of an electrostatic latent image bearing body by charging means and then exposing the electrostatic latent image bearing body with a laser optical system or LED array. As the charging means, non-contact type chargers such as Corotron, Scorotron and contact type chargers for charging the electrostatic latent image bearing body surface by applying voltage to a conductive member brought into contact with the electrostatic latent image bearing body surface can be exemplified and any type chargers can be employed. However, from the viewpoint of suppressed ozone generation amount and environment-friendly and high printing-resistant properties, the contact type chargers are preferable. With respect to the above-mentioned contact type chargers may comprise conductive members with brush-like, blade-like, pin-electrode type, roller type shapes and those comprising roller type conductive members are preferable.

The image forming method of the invention is not at all particularly limited in the process of forming the electrostatic latent image.

The process of carrying out development using the above-mentioned developer involves steps of bringing a developer carrier having a toner-containing developer layer on the surface into contact with or near the electrostatic latent image bearing body surface to stick the toner particles to the electrostatic latent image to the electrostatic latent image bearing body surface and thereby forming a toner image on the electrostatic latent image bearing body surface. Conventionally known methods can be employed for the development and as the development method using a two-component type developer to be used for the invention, a cascade type method and a magnetic brush method can be exemplified. The development may be carried out by either so-called normal development method or reversal development method and the reversal development method is preferably employed. The image forming method of the invention is not at all particularly limited with respect to the development method.

The process of transferring is process for forming a transfer image to an object transfer material by transferring the toner image formed on the electrostatic latent image bearing body surface. In the case of color image formation, it is preferable to carry out primary transfer of toners with respective colors to an intermediate transfer drum or belt, as an object transfer material, and then secondary transfer to a recording medium such as paper.

As a transfer device for transferring the toner image to paper or an intermediate transfer body from a photoreceptor, Corotron can be employed. The Corotron is effective as charging means for evenly charging paper and in order to provide a prescribed charge property to paper as a recording medium, voltage as high as several kv is required to apply and therefore, a high voltage power source is necessary. Further, since the corona discharge generates ozone, it causes rubber members and the photosensitive bodies and therefore, the contact transfer method for transferring the toner image to paper by contacting a conductive transfer roll made of an elastic material with the electrostatic latent image bearing body is preferable.

The image forming method of the invention is not at all particularly limited with respect to the transfer device.

The above-mentioned fusing process is for fusing the toner image transferred to the recording medium surface by a fusing device. As the fusing device, a heating fusing apparatus using a heat roll as a fusing medium is preferably employed. The heating fusing apparatus comprises a fusing roller provided with a heater lamp for heating in the inside of a cylindrical core metal and a so-called release layer of a heat resistant resin coating layer or heat resistant rubber coating formed on the outer circumference of the cylindrical core metal and a pressurizing roller or pressurizing belt installed while being pressed to the fusing roller and manufactured by forming a heat resistant elastic layer on the outer circumferential face of a cylindrical core metal or a belt-like substrate surface. The fusing process of an un-fused toner image is carried out by passing the recording medium on which the un-fused toner image is formed between the fusing roller and the pressurizing roller or belt and thereby thermally melting the binder resin and additives in the toner. The fusing temperature is preferably set to be 160° C. or higher, more preferably 180° C. or higher. The fusing nip-passing time of the recording medium is preferably in a range of 20 to 100 msec.

The image forming method of the invention is not at all particularly limited with respect to the fusing method.

As described above, owing to use of a specified toner to be used for the invention, it is made possible to widen the option of usable resins for the above-mentioned resin coating materials and improve the low temperature fusing property and the durability of the heating medium while keeping the peeling property of the toner from the resin coating on the heating medium surface.

EXAMPLES

Hereinafter, the present invention will be described in details with reference to Examples, however it is not intended that the invention be limited to the illustrated Examples.

The term, "parts" in the Examples and Comparative Examples means "parts by weight".

At first, toners, developers, and heating media to be used in the Examples and the Comparative Examples of the invention will be described.

Methods for Measuring Various Physical Properties

The average particle sizes of the toners in the following description are measured by COULTER COUNTER (trade name: TA2 model, manufactured by Beckman Coulter, Inc.). The glass transition points of the resin particles and the resins in the toner particles are measured by using a scanning differential thermometer (trade name: DSC-50, manufactured by Shimadzu Corporation) under the condition of 3° C./min temperature raising speed.

The average particle sizes of the resin particles, the coloring agent particles and the releasing agent particles in the emulsion-polymerization aggregation process are measured by using a laser diffraction type particle size distribution measurement apparatus (trade name: LA-700, manufactured by Horiba Ltd.). Further, the molecular weights and molecular weight distribution of the resins in the resin particles and the toner particles are measured by gel permeation chromatography (trade name: HLC-8120 GPC, manufactured by Tosoh Corporation).

The storage elasticity G' is measured using a viscoelasticity measurement apparatus (trade name: ARES, manufactured by Rheometric Scientific FE. Ltd.) by forming tablets of toners for electrostatic latent image development, setting them in 20 mmϕ parallel plate, and subjecting them to vibration of 6.28 rad/sec vibration frequency after normal force is set at 0. The measurement temperature range is from 160° C. to 240° C. and the strain at that time is adjusted to be 0.3%. The measurement intervals are 120 sec. and the temperature raising speed after starting the measurement is set to be 1° C./min and the storage elasticity at 180° C. is employed as the storage elasticity G'.

The contact angles of the heating medium surfaces to water at 25° C. are measured using a contact angle meter (trade name: CA-D, manufactured by Kyowa Interface Science Co.,) by dropwise adding pure water to fusing roll surfaces under conditions of 25° C. and 50% RH and measuring the contact angles when the width of the titrated droplets becomes 1.0 mm. The measurement is carried out at 10-points and their average values are employed as the contact angles.

Production of Fusing Rolls (Heating Media)

Production of Fusing Roll (1)

After a phenol resin (trade name: PS 4152, manufactured by Gun-ei Chemical Industry Co., Ltd.) 10 parts is sufficiently dissolved in highest-grade ethanol (highest grade, manufactured by Wako Pure Chemical Industries, Ltd.) 140 parts, the obtained mixture is applied to the surface of a stainless roll (diameter: 35 mm; length: 320 mm; thickness: 2 mm) by a normal method. The roll is kept at 150° C. for 2 hours in a thermostat and then cooled to a room temperature to produce a fusing roll (1) bearing a 20 μm-thick resin coating layer.

The contact angle of the surface of the fusing roll (1) at 25° C. to water is 76°.

Production of Fusing Roll (2)

After a phenol resin (trade name: PS 4152, manufactured by Gun-ei Chemical Industry Co., Ltd.) 10 parts and silicone varnish (trade name: KR 9760, manufactured by Shin-Etsu Chemical Co., Ltd.) 10 parts are sufficiently dissolved in highest-grade ethanol (highest grade, manufactured by Wako Pure Chemical Industries, Ltd.) 130 parts, the obtained mixture is applied to the surface of a stainless roll (diameter: 35 mm; length: 320 mm; thickness: 2 mm) by a normal method. The roll is kept at 150° C. for 2 hours in a thermostat and then cooled to a room temperature to produce a fusing roll (2) bearing a 30 μm-thick resin coating layer.

The contact angle of the surface of the fusing roll (2) at 25° C. to water is 94°.

Production of Fusing Roll (3)

After a phenol resin (trade name: PS 4152, manufactured by Gun-ei Chemical Industry Co., Ltd.) 10 parts and a poly(vinyl formal) resin (trade name: VINYLEX K, manufactured by Chisso Corporation) 2 parts are sufficiently dissolved in THF (highest grade, manufactured by Wako Pure Chemical Industries, Ltd.) 138 parts, the obtained mixture is applied to the surface of a stainless roll (diameter: 35 mm; length: 320 mm; thickness: 2 mm) by a normal method. The roll is kept at 150° C. for 2 hours in a thermostat and then cooled to a room temperature to produce a fusing roll (2) bearing a 25 μm-thick resin coating layer.

The contact angle of the surface of the fusing roll (3) at 25° C. to water is 60°.

Production of Fusing Roll (4)

After a poly(phenylene sulfide) resin (manufactured by Toray Industries, Inc) 100 parts is applied by powder coating to the surface of a stainless roll (diameter: 35 mm; length: 320 mm; thickness: 2 mm) by a normal method and thereby a fusing roll (4) bearing a 40 μm-thick resin coating layer is produced.

The contact angle of the surface of the fusing roll (4) at 25° C. to water is 84°.

Production of Fusing Roll (5)

After a silicone resin (trade name: KR 112, manufactured by Shin-Etsu Chemical Co., Ltd.) 20 parts is sufficiently dissolved in toluene (highest grade, manufactured by Wako Pure Chemical Industries, Ltd.) 100 parts, the obtained mixture is applied to the surface of a stainless roll (diameter: 35 mm; length: 320 mm; thickness: 2 mm) by a normal method. The roll is kept at 200° C. for 2 hours in a thermostat and then cooled to a room temperature to produce a fusing roll (5) bearing a 15 μm-thick resin coating layer.

The contact angle of the surface of the fusing roll (5) at 25° C. to water is 110°.

Production of Fusing Roll (6)

After a fluororesin (trade name: ZEFFLE GK, manufactured by Daikin Industries, Ltd.) 20 parts is sufficiently dissolved in THF (highest grade, manufactured by Wako Pure Chemical Industries, Ltd.) 40 parts, the obtained mixture is applied to the surface of a stainless roll (diameter: 35 mm; length: 320 mm; thickness: 2 mm) by a normal method. The roll is kept at 100° C. for 1 hours in a thermostat and then cooled to a room temperature to produce a fusing roll (6) bearing a 30 μm-thick resin coating layer.

The contact angle of the surface of the fusing roll (6) at 25° C. to water is 116°.

Production of Fusing Roll (7)

After a cyclohexanone resin (trade name: K 90, manufactured by Arakawa Chemical Industries, Ltd.) 20 parts and a phenol resin (trade name: PG 4121, manufactured by Gun-ei Chemical Industry Co., Ltd.) 5 parts are sufficiently dissolved in acetone (highest grade, manufactured by Wako Pure Chemical Industries, Ltd.) 100 parts, the obtained mixture is applied to the surface of a stainless roll (diameter: 35 mm; length: 320 mm; thickness: 2 mm) by a normal method. The roll is kept at 200° C. for 2 hours in a thermostat and then cooled to a room temperature to produce a fusing roll (7) bearing a 25 μm-thick resin coating layer.

The contact angle of the surface of the fusing roll (7) at 25° C. to water is 40°.

Production of Fusing Roll (8)

A roll (diameter: 35 mm; length: 320 mm; thickness: 2 mm) made of aluminum is used as it is. The roll is used as a fusing roll (8).

The contact angle of the surface of the fusing roll (8) at 25° C. to water is 45°.

Production of Toners for Electrostatic Latent Image Development

Production of Various Kinds of Dispersions

Production of Resin Particle Dispersion (1)

| | |
|---|---|
| Styrene | 308 parts |
| n-Butyl acrylate | 89 parts |
| 2-ethylhexyl acrylate | 3 parts |
| Acrylic acid | 10 parts |
| Tert-dodecylmercaptan | 10 parts |
| Hexanediol diacrylate | 3 parts |

A mixture obtained by mixing and dissolving the above-mentioned respective components (all manufactured by Wako Pure Chemical Industries, Ltd.) is dispersed and emulsified in a mixture obtained by dissolving a nonionic surfactant (trade name: NONIPOL 8.5, manufactured by Sanyo Chemical Industries, Ltd.) 4 parts and an anionic surfactant (trade name: NEOGEN RK, manufactured by Dai-Ichi Kogyo Seiyaku Co., Ltd.) 8 parts in ion-exchanged water 600 parts in a flask and while the obtained mixture being moderately stirred for 10 minutes, ion-exchanged water 50 parts in which potassium persulfate (manufactured by Wako Pure Chemical Industries, Ltd.) 4 parts is dissolved is added to carry out nitrogen substitution and after that, while being stirred in the flask, the contents are heated to 70° C. in an oil bath and the emulsion polymerization is continued for 7 hours. After that, the reaction solution is cooled to a room temperature to obtain resin particle dispersion (1).

Next, a portion of the resin particle dispersion (1) is left on an oven at 80° C. to remove water and the properties of the residue are measured to find that the average particle size is 198 nm, the glass transition point is 52° C., and the weight average molecular weight Mw is 28,000.

Production of Resin Particle Dispersion (2)

| | |
|---|---|
| Styrene | 280 parts |
| n-Butyl acrylate | 120 parts |

A mixture obtained by mixing and dissolving the above-mentioned respective components (all manufactured by Wako Pure Chemical Industries, Ltd.) is dispersed and emulsified in a mixture obtained by dissolving a nonionic surfactant (trade name: NONIPOL 8.5, manufactured by Sanyo Chemical Industries, Ltd.) 4 parts and an anionic surfactant (trade name: NEOGEN RK, manufactured by Dai-Ichi Kogyo Seiyaku Co., Ltd.) 8 parts in ion-exchanged water 580 parts in a flask and while the obtained mixture being moderately stirred for 10 minutes, ion-exchanged water 50 parts in which potassium persulfate (manufactured by Wako Pure Chemical Industries, Ltd.) 0.4 parts is dissolved is added to carry out nitrogen substitution and after that, while being stirred in the flask, the contents are heated to 70° C. in an oil bath and the emulsion polymerization is continued for 7 hours. After that, the reaction solution is cooled to a room temperature to obtain resin particle dispersion (2).

Next, a portion of the resin particle dispersion (2) is left on an oven at 80° C. to remove water and the properties of the residue are measured to find that the average particle size is 188 nm, the glass transition point is 54° C., and the weight average molecular weight Mw is 744,000.

Production of Resin Particle Dispersion (3)

| | |
|---|---|
| Styrene | 310 parts |
| n-Butyl acrylate | 88 parts |
| 2-ethylhexyl acrylate | 2 parts |
| Acrylic acid | 5 parts |
| Tert-dodecylmercaptan | 1 part |
| Octanediol diacrylate | 5 parts |

A mixture obtained by mixing and dissolving the above-mentioned respective components (all manufactured by Wako Pure Chemical Industries, Ltd.) is dispersed and emulsified in a mixture obtained by dissolving a nonionic surfactant (trade name: NONIPOL 8.5, manufactured by Sanyo Chemical Industries, Ltd.) 4 parts and an anionic surfactant (trade name: NEOGEN RK, manufactured by Dai-Ichi Kogyo Seiyaku Co., Ltd.) 8 parts in ion-exchanged water 600 parts in a flask and while the obtained mixture being moderately stirred for 10 minutes, ion-exchanged water 50 parts in which potassium persulfate (manufactured by Wako Pure Chemical Industries, Ltd.) 1 parts is dissolved is added to carry out nitrogen substitution and after that, while being stirred in the flask, the contents are heated to 70° C. in an oil bath and the emulsion polymerization is continued for 7 hours. After that, the reaction solution is cooled to a room temperature to obtain resin particle dispersion (3).

Next, a portion of the resin particle dispersion (3) is left on an oven at 80° C. to remove water and the properties of the residue are measured to find that the average particle size is 222 nm, the glass transition point is 53° C., and the weight average molecular weight Mw is 171,000.

Production of Resin Particle Dispersion (4)

| | |
|---|---|
| Styrene | 330 parts |
| n-Butyl acrylate | 66 parts |
| 2-ethylhexyl acrylate | 4 parts |
| Acrylic acid | 5 parts |
| Tert-dodecylmercaptan | 6 parts |
| Decanediol diacrylate | 12 parts |

A mixture obtained by mixing and dissolving the above-mentioned respective components (all manufactured by Wako Pure Chemical Industries, Ltd.) is dispersed and emulsified in a mixture obtained by dissolving a nonionic surfactant (trade name: NONIPOL 8.5, manufactured by Sanyo Chemical Industries, Ltd.) 4 parts and an anionic surfactant (trade name: NEOGEN RK, manufactured by Dai-Ichi Kogyo Seiyaku Co., Ltd.) 8 parts in ion-exchanged water 600 parts in a flask and while the obtained mixture being moderately stirred for 10 minutes, ion-exchanged water 50 parts in which potassium persulfate (manufactured by Wako Pure Chemical Industries, Ltd.) 1 parts is dissolved is added to carry out nitrogen substitution and after that, while being stirred in the flask, the contents are heated to 70° C. in an oil bath and the emulsion polymerization is continQed for 7 hours. After that, the reaction solution is cooled to a room temperature to obtain resin particle dispersion (4).

Next, a portion of the resin particle dispersion (4) is left on an oven at 80° C. to remove water and the properties of the residue are measured to find that the average particle size is 235 nm, the glass transition point is 57° C., and the weight average molecular weight Mw of solvent-soluble component is 62,000 and solvent-insoluble components are found.

Production of Resin Particle Dispersion (5)

| | |
|---|---|
| Styrene | 308 parts |
| n-Butyl acrylate | 89 parts |
| 2-ethylhexyl acrylate | 3 parts |
| Tert-dodecylmercaptan | 10 part |
| Hexanediol diacrylate | 3 parts |

A mixture obtained by mixing and dissolving the above-mentioned respective components (all manufactured by Wako Pure Chemical Industries, Ltd.) is dispersed and emulsified in a mixture obtained by dissolving a nonionic surfactant (trade name: NONIPOL 8.5, manufactured by Sanyo Chemical Industries, Ltd.) 4 parts and an anionic surfactant (trade name: NEOGEN RK, manufactured by Dai-Ichi Kogyo Seiyaku Co., Ltd.) 8 parts in ion-exchanged water 600 parts in a flask and while the obtained mixture being moderately stirred for 10 minutes, ion-exchanged water 50 parts in which potassium persulfate (manufactured by Wako Pure Chemical Industries, Ltd.) 4 parts is dissolved is added to carry out nitrogen substitution and after that, while being stirred in the flask, the contents are heated to 70° C. in an oil bath and the emulsion polymerization is continued for 7 hours. After that, the reaction solution is cooled to a room temperature to obtain resin particle dispersion (5).

Next, a portion of the resin particle dispersion (5) is left on an oven at 80° C. to remove water and the properties of the residue are measured to find that the average particle size is 202 nm, the glass transition point is 52° C., and the weight average molecular weight Mw is 27,000.

Production of Coloring Agent Dispersions

Production of Coloring Agent Dispersion (1)

| | |
|---|---|
| Carbon black (trade name: REGAL 330, manufactured by Cabot Corporation) | 50 parts |
| Anionic surfactant (trade name: NEOGEN RK, manufactured BY Dai-Ichi Kogyo Seiyaku Co., Ltd.) | 1.0 part |
| Ion-exchanged water | 150 parts |

After being mixed and dissolved, the above-mentioned components are dispersed by a homogenizer (trade name: ULTRA-TURRAX, manufactured by IKA Japan K.K.) to obtain a coloring agent dispersion (1) containing the coloring agent (the carbon black) therein is obtained.

Production of Coloring Agent Dispersion (2)

| | |
|---|---|
| Phthalocyanine pigment (trade name: PV FAST BLUE, manufactured by Dainichiseika Color & Chemicals Mfg. Co., Ltd.) | 50 parts |
| Anionic surfactant (trade name: NEOGEN RK, manufactured by Dai-Ichi Kogyo Seiyaku Co., Ltd.) | 1.0 part |
| Ion-exchanged water | 150 parts |

After being mixed and dissolved, the above-mentioned components are dispersed by a homogenizer (trade name: ULTRA-TURRAX, manufactured by IKA Japan K.K.) to obtain a coloring agent dispersion (2) containing the coloring agent (the phthalocyanine pigment) therein is obtained.

Production of Coloring Agent Dispersion (3)

| | |
|---|---|
| Magenta pigment (trade name: PR 122, manufactured by Dainichiseika Color & Chemicals Mfg. Co., Ltd.) | 50 parts |
| Anionic surfactant (trade name: NEOGEN RK, manufactured by Dai-Ichi Kogyo Seiyaku Co., Ltd.) | 1.0 part |
| Ion-exchanged water | 150 parts |

After being mixed and dissolved, the above-mentioned components are dispersed by a homogenizer (trade name: ULTRA-TURRAX, manufactured by IKA Japan K.K.) to obtain a coloring agent dispersion (3) containing the coloring agent (the magenta pigment) therein is obtained.

Production of Coloring Agent Dispersion (4)

| | |
|---|---|
| Yellow pigment (trade name: PY 180, manufactured by Clariant (Japan) K.K.) | 50 parts |
| Anionic surfactant (trade name: NEOGEN RK, manufactured by Dai-Ichi Kogyo Seiyaku Co., Ltd.) | 1.0 part |
| Ion-exchanged water | 150 parts |

After being mixed and dissolved, the above-mentioned components are dispersed by a homogenizer (trade name: ULTRA-TURRAX, manufactured by IKA Japan K.K.) to obtain a coloring agent dispersion (4) containing the coloring agent (the magenta pigment) therein is obtained.

Production of Releasing Agent Dispersions

Production of Releasing Agent Particle Dispersion (1)

| | |
|---|---|
| Paraffin wax (trade name: HNP-12, melting point: 67° C., manufactured by Nippon Seiro Co., Ltd.) | 80 parts |
| Anionic surfactant (trade name: NEOGEN RK, manufactured by Dai-Ichi Kogyo Seiyaku Co., Ltd.) | 1.0 part |
| Ion-exchanged water | 120 parts |

After being mixed and dissolved at 85° C., the above-mentioned components are dispersed by a homogenizer (trade name: ULTRA-TURRAX, manufactured by IKA Japan K.K.) to obtain a releasing agent particle dispersion (1) containing the paraffin wax therein is obtained.

Production of Releasing Agent Particle Dispersion (2)

| | |
|---|---|
| Sorbitan tribehenate (melting point: 70° C., manufactured by Riken Vitamin Co., Ltd.) | 80 parts |
| Anionic surfactant (trade name: NEOGEN RK, manufactured by Dai-Ichi Kogyo Seiyaku Co., Ltd.) | 1.0 part |
| Ion-exchanged water | 120 parts |

After being mixed and dissolved at 85° C., the above-mentioned components are dispersed by a homogenizer (trade name: ULTRA-TURRAX, manufactured by IKA Japan K.K.) to obtain a releasing agent particle dispersion (2) containing the polyethylene wax therein is obtained.

Production of Releasing Agent Particle Dispersion (3)

| | |
|---|---|
| Propylene glycol laurate (melting point: 70° C., manufactured by Riken Vitamin Co., Ltd.) | 80 parts |
| Anionic surfactant (trade name: NEOGEN RK, manufactured by Dai-Ichi Kogyo Seiyaku Co., Ltd.) | 1.0 part |
| Ion-exchanged water | 120 parts |

After being mixed and dissolved at 95° C., the above-mentioned components are dispersed by a homogenizer (trade name: ULTRA-TURRAX, manufactured by IKA Japan K.K.) to obtain a releasing agent particle dispersion (3) containing the polyethylene wax therein is obtained.

After being mixed and dissolved at 85° C., the above-mentioned components are dispersed by a homogenizer (trade name: ULTRA-TURRAX, manufactured by IKA Japan K.K.) to obtain a releasing agent particle dispersion (2) containing the polyethylene wax therein is obtained.

Production of Toners

Production of Toner for Electrostatic latent Image Development (1)

Aggregation Step

| | |
|---|---|
| Resin particle dispersion (1) | 150 parts |
| Resin particle dispersion (2) | 100 parts |
| Coloring agent dispersion (1) | 40 parts |
| Releasing agent particle dispersion (1) | 100 parts |
| Ion-exchanged water | 920 parts |
| Aluminum sulfate (manufactured by Wako Pure Chemical Industries, Ltd.) | 6 parts |

After the above-mentioned components are all put in a round type flask made of a stainless steel and dispersed by a homogenizer (trade name: ULTRA-TURRAX T 50, manufactured by IKA Japan K.K.), the mixture in the flask is adjusted at pH 2.6 and heated to 49° C. in a heating oil bath under stirring condition. After the product being kept at 49° C. for 30 minutes, observation of the product by an optical microscope is carried out to find that flocculated particles with an average particle size of about 5.0 μm are formed. The resin particle dispersion (1) 125 parts is gently added to the obtained flocculate particle dispersion and further heated and stirred at 49° C. for 60 minutes while pH being kept at 2.6 and then observation of the product by an optical microscope is carried out to find that flocculated particles with an average particle size of about 5.4 μm are formed.

Coalescence Step

The obtained flocculate particle dispersion has pH 2.7. An aqueous solution containing 0.5% by weight of sodium hydroxide (manufactured by Wako Pure Chemical Industries, Ltd.) is slowly added to adjust the pH to be 4.8, the dispersion is heated to 96° C. while being continuously stirred and kept for 5 hours. After that, the obtained content in the flask is adjusted at pH about 7, the reaction product is filtered and washed four times with ion-exchanged water 500 parts and then dried by a vacuum drier to obtain a toner particle (1).

The obtained toner particle (1) has a volume average particle size of 5.5 μm, a shape factor SF1 of 136, Mw 172,000, and Mw/Mn 5.3. The storage elasticity at 180° C. [G'(180)] is found to be $5.5\times10^3$ Pa.

Hydrophobic titanium oxide (trade name: T805, average particle size: 0.021 μm, manufactured by Nippon Aerosil Co., Ltd.) 2 parts and hydrophobic silica (trade name: RX 50, average particle size: 0.040 μm, manufactured by Nippon Aerosil Co., Ltd.) 10 parts are extrapolated to the obtained toner particle (1) 100 parts and mixed by a Henshel mixer to obtain a toner for electrostatic latent image development (1).

Production of Toner for Electrostatic Latent Image Development (2)

Aggregation Step

| | |
|---|---|
| Resin particle dispersion (1) | 150 parts |
| Resin particle dispersion (2) | 100 parts |
| Coloring agent dispersion (2) | 40 parts |
| Releasing agent particle dispersion (1) | 100 parts |
| Ion-exchanged water | 920 parts |
| Aluminum sulfate (manufactured by Wako Pure Chemical Industries, Ltd.) | 6.5 parts |

After the above-mentioned components are all put in a round type flask made of a stainless steel and dispersed by a homogenizer (trade name: ULTRA-TURRAX T 50, manufactured by IKA Japan K.K.), the mixture in the flask is adjusted at pH 2.6 and heated to 49° C. in a heating oil bath under stirring condition. After the product being kept at 49° C. for 30 minutes, observation of the product by an optical microscope is carried out to find that flocculated particles with an average particle size of about 5.5 μm are formed. The resin particle dispersion (1) 125 parts is gently added to the obtained flocculate particle dispersion and further heated and stirred at 49° C. for 60 minutes while pH being kept at 2.6 and then observation of the product by an optical microscope is carried out to find that flocculated particles with an average particle size of about 5.9 μm are formed.

Coalescence Step

The obtained flocculate particle dispersion has pH 2.7. An aqueous solution containing 0.5% by weight of sodium hydroxide (manufactured by Wako Pure Chemical Industries, Ltd.) is slowly added to adjust the pH to be 4.8, the dispersion is heated to 96° C. while being continuously stirred and kept for 5 hours. After that, the obtained content in the flask is adjusted at pH about 7, the reaction product is filtered and washed four times with ion-exchanged water 500 parts and then dried by a vacuum drier to obtain a toner particle (2).

The obtained toner particle (2) has a volume average particle size of 6.0 μm, a shape factor SF1 of 138, Mw 170,000, and Mw/Mn 5.3. The storage elasticity at 180° C. [G'(180)] is found to be $6.1\times10^3$ Pa.

Hydrophobic titanium oxide (trade name: T805, average particle size: 0.021 μm, manufactured by Nippon Aerosil Co., Ltd.) 2 parts and hydrophobic silica (trade name: RX 50, average particle size: 0.040 μm, manufactured by Nippon Aerosil Co., Ltd.) 10 parts are extrapolated to the obtained toner particle (2) 100 parts and mixed by a Henshel mixer to obtain a toner for electrostatic latent image development (2).

Production of Toner for Electrostatic Latent Image Development (3)

Aggregation Step

| | |
|---|---|
| Resin particle dispersion (1) | 150 parts |
| Resin particle dispersion (2) | 100 parts |
| Coloring agent dispersion (3) | 40 parts |
| Releasing agent particle dispersion (1) | 100 parts |
| Ion-exchanged water | 920 parts |
| Aluminum sulfate (manufactured by Wako Pure Chemical Industries, Ltd.) | 5.2 parts |

After the above-mentioned components are all put in a round type flask made of a stainless steel and dispersed by a homogenizer (trade name: ULTRA-TURRAX T 50, manufactured by IKA Japan K.K.), the mixture in the flask is adjusted at pH 2.6 and heated to 49° C. in a heating oil bath under stirring condition. After the product being kept at 49° C. for 30 minutes, observation of the product by an optical microscope is carried out to find that flocculated particles with an average particle size of about 5.4 μm are formed. The resin particle dispersion (1) 125 parts is gently added to the obtained flocculate particle dispersion and further heated and stirred at 49° C. for 60 minutes while pH being kept at 2.6 and then observation of the product by an optical microscope is carried out to find that flocculated particles with an average particle size of about 5.7 μm are formed.

Coalescence Step

The obtained flocculate particle dispersion has pH 2.6. An aqueous solution containing 0.5% by weight of sodium hydroxide (manufactured by Wako Pure Chemical Industries, Ltd.) is slowly added to adjust the pH to be 4.8, the dispersion is heated to 96° C. while being continuously stirred and kept for 5 hours. After that, the obtained content in the flask is adjusted at pH about 7, the reaction product is filtered and washed four times with ion-exchanged water 500 parts and then dried by a vacuum drier to obtain a toner particle (3).

The obtained toner particle (3) has a volume average particle size of 5.9 μm, a shape factor SF1 of 132, Mw 170,000, and Mw/Mn 5.3. The storage elasticity at 180° C. [G'(180)] is found to be $3.2\times10^3$ Pa.

Hydrophobic titanium oxide (trade name: T805, average particle size: 0.021 μm, manufactured by Nippon Aerosil Co., Ltd.) 2 parts and hydrophobic silica (trade name: RX 50, average particle size: 0.040 μm, manufactured by Nippon Aerosil Co., Ltd.) 10 parts are extrapolated to the obtained toner particle (3) 100 parts and mixed by a Henshel mixer to obtain a toner for electrostatic latent image development (3).

Production of Toner for Electrostatic Latent Image Development (4)

Aggregation Step

| | |
|---|---|
| Resin particle dispersion (1) | 150 parts |
| Resin particle dispersion (2) | 100 parts |
| Coloring agent dispersion (4) | 40 parts |
| Releasing agent particle dispersion (1) | 100 parts |
| Ion-exchanged water | 920 parts |
| Aluminum sulfate (manufactured by Wako Pure Chemical Industries, Ltd.) | 5.4 parts |

After the above-mentioned components are all put in a round type flask made of a stainless steel and dispersed by a homogenizer (trade name: ULTRA-TURRAX T 50, manufactured by IKA Japan K.K.), the mixture in the flask is adjusted at pH 2.6 and heated to 49° C. in a heating oil bath under stirring condition. After the product being kept at 49° C. for 30 minutes, observation of the product by an optical microscope is carried out to find that flocculated particles with an average particle size of about 5.0 μm are formed. The resin particle dispersion (1) 125 parts is gently added to the obtained flocculate particle dispersion and further heated and stirred at 49° C. for 60 minutes while pH being kept at 2.6 and then observation of the product by an optical microscope is carried out to find that flocculated particles with an average particle size of about 5.6 μm are formed.

Coalescence Step

The obtained flocculate particle dispersion has pH 2.7. An aqueous solution containing 0.5% by weight of sodium hydroxide (manufactured by Wako Pure Chemical Industries, Ltd.) is slowly added to adjust the pH to be 4.8, the dispersion is heated to 96° C. while being continuously stirred and kept for 5 hours. After that, the obtained content in the flask is adjusted at pH about 7, the reaction product is filtered and washed four times with ion-exchanged water 500 parts and then dried by a vacuum drier to obtain a toner particle (4).

The obtained toner particle (4) has a volume average particle size of 5.7 μm, a shape factor SF1 of 136, Mw 173,000, and Mw/Mn 5.3. The storage elasticity at 180° C. [G'(180)] is found to be $4.2\times10^3$ Pa.

Hydrophobic titanium oxide (trade name: T805, average particle size: 0.021 μm, manufactured by Nippon Aerosil Co., Ltd.) 2 parts and hydrophobic silica (trade name: RX 50, average particle size: 0.040 μm, manufactured by Nippon Aerosil Co., Ltd.) 10 parts are extrapolated to the obtained toner particle (4) 100 parts and mixed by a Henshel mixer to obtain a toner for electrostatic latent image development (4).

Production of Toner for Electrostatic Latent Image Development (5)

Aggregation Step

| | |
|---|---|
| Resin particle dispersion (1) | 100 parts |
| Resin particle dispersion (2) | 150 parts |
| Coloring agent dispersion (1) | 40 parts |
| Releasing agent particle dispersion (1) | 100 parts |
| Ion-exchanged water | 920 parts |
| Aluminum sulfate (manufactured by Wako Pure Chemical Industries, Ltd.) | 7.6 parts |

After the above-mentioned components are all put in a round type flask made of a stainless steel and dispersed by a homogenizer (trade name: ULTRA-TURRAX T 50, manufactured by IKA Japan K.K.), the mixture in the flask is adjusted at pH 2.6 and heated to 49° C. in a heating oil bath under stirring condition. After the product being kept at 49° C. for 30 minutes, observation of the product by an optical microscope is carried out to find that flocculated particles with an average particle size of about 6.8 μm are formed. The resin particle dispersion (1) 125 parts is gently added to the obtained flocculate particle dispersion and further heated and stirred at 49° C. for 60 minutes while pH being kept at 2.6 and then observation of the product by an optical microscope is carried out to find that flocculated particles with an average particle size of about 7.2 μm are formed.

Coalescence Step

The obtained flocculate particle dispersion has pH 2.7. An aqueous solution containing 0.5% by weight of sodium hydroxide (manufactured by Wako Pure Chemical Industries, Ltd.) is slowly added to adjust the pH to be 4.0, the dispersion is heated to 96° C. while being continuously stirred and kept for 5 hours. After that, the obtained content in the flask is adjusted at pH about 7, the reaction product is filtered and washed four times with ion-exchanged water 500 parts and then dried by a vacuum drier to obtain a toner particle (5).

The obtained toner particle (5) has a volume average particle size of 8.0 μm, a shape factor SF1 of 144, Mw 207,000, and Mw/Mn 5.5. The storage elasticity at 180° C. [G'(180)] is found to be $7.7\times10^3$ Pa.

Hydrophobic titanium oxide (trade name: T805, average particle size: 0.021 μm, manufactured by Nippon Aerosil Co., Ltd.) 2 parts and hydrophobic silica (trade name: RX 50, average particle size: 0.040 μm, manufactured by Nippon Aerosil Co., Ltd.) 10 parts are extrapolated to the obtained toner particle (5) 100 parts and mixed by a Henshel mixer to obtain a toner for electrostatic latent image development (5).

Production of Toner for Electrostatic Latent Image Development (6)

Aggregation Step

| | |
|---|---|
| Resin particle dispersion (1) | 210 parts |
| Resin particle dispersion (2) | 40 parts |
| Coloring agent dispersion (1) | 40 parts |
| Releasing agent particle dispersion (2) | 100 parts |
| Ion-exchanged water | 920 parts |
| Aluminum sulfate (manufactured by Wako Pure Chemical Industries, Ltd.) | 7.5 parts |

After the above-mentioned components are all put in a round type flask made of a stainless steel and dispersed by a homogenizer (trade name: ULTRA-TURRAX T 50, manufactured by IKA Japan K.K.), the mixture in the flask is adjusted at pH 2.6 and heated to 49° C. in a heating oil bath under stirring condition. After the product being kept at 49° C. for 30 minutes, observation of the product by an optical microscope is carried out to find that flocculated particles with an average particle size of about 5.7 μm are formed. The resin particle dispersion (1) 125 parts is gently added to the obtained flocculate particle dispersion and further heated and stirred at 49° C. for 60 minutes while pH being kept at 2.6 and then observation of the product by an optical microscope is carried out to find that flocculated particles with an average particle size of about 6.2 μm are formed.

Coalescence Step

The obtained flocculate particle dispersion has pH 2.7. An aqueous solution containing 0.5% by weight of sodium hydroxide (manufactured by Wako Pure Chemical Industries, Ltd.) is slowly added to adjust the pH to be 5.0, the dispersion is heated to 96° C. while being continuously stirred and kept for 5 hours. After that, the obtained content in the flask is adjusted at pH about 7, the reaction product is filtered and washed four times with ion-exchanged water 500 parts and then dried by a vacuum drier to obtain a toner particle (6).

The obtained toner particle (6) has a volume average particle size of 7.4 μm, a shape factor SF1 of 121, Mw 106,000, and Mw/Mn 4.7. The storage elasticity at 180° C. [G'(180)] is found to be $1.5\times10^3$ Pa.

Hydrophobic titanium oxide (trade name: T805, average particle size: 0.021 μm, manufactured by Nippon Aerosil Co., Ltd.) 2 parts and hydrophobic silica (trade name: RX 50, average particle size: 0.040 μm, manufactured by Nippon Aerosil Co., Ltd.) 10 parts are extrapolated to the obtained toner particle (6) 100 parts and mixed by a Henshel mixer to obtain a toner for electrostatic latent image development (6).

Production of Toner for Electrostatic Latent Image Development (7)

Aggregation Step

| | |
|---|---|
| Resin particle dispersion (3) | 250 parts |
| Coloring agent dispersion (1) | 40 parts |
| Releasing agent particle dispersion (1) | 100 parts |
| Ion-exchanged water | 920 parts |
| Aluminum sulfate (manufactured by Wako Pure Chemical Industries, Ltd.) | 6.0 parts |

After the above-mentioned components are all put in a round type flask made of a stainless steel and dispersed by a homogenizer (trade name: ULTRA-TURRAX T 50, manufactured by IKA Japan K.K.), the mixture in the flask is adjusted at pH 2.6 and heated to 49° C. in a heating oil bath under stirring condition. After the product being kept at 49° C. for 30 minutes, observation of the product by an optical microscope is carried out to find that flocculated particles with an average particle size of about 5.0 μm are formed. The resin particle dispersion (3) 125 parts is gently added to the obtained flocculate particle dispersion and further heated and stirred at 49° C. for 60 minutes while pH being kept at 2.6 and then observation of the product by an optical microscope is carried out to find that flocculated particles with an average particle size of about 5.3 Mm are formed.

Coalescence Step

The obtained flocculate particle dispersion has pH 2.7. An aqueous solution containing 0.5% by weight of sodium hydroxide (manufactured by Wako Pure Chemical Industries, Ltd.) is slowly added to adjust the pH to be 4.4, the dispersion is heated to 96° C. while being continuously stirred and kept for 5 hours. After that, the obtained content in the flask is adjusted at pH about 7, the reaction product is filtered and washed four times with ion-exchanged water 500 parts and then dried by a vacuum drier to obtain a toner particle (7).

The obtained toner particle (7) has a volume average particle size of 5.7 μm, a shape factor SF1 of 138, Mw 171,000, and Mw/Mn 5.3. The storage elasticity at 180° C. [G'(180)] is found to be $4.5\times10^3$ Pa.

Hydrophobic titanium oxide (trade name: T805, average particle size: 0.021 μm, manufactured by Nippon Aerosil Co., Ltd.) 2 parts and hydrophobic silica (trade name: RX 50, average particle size: 0.040 μm, manufactured by Nippon Aerosil Co., Ltd.) 10 parts are extrapolated to the obtained toner particle (7) 100 parts and mixed by a Henshel mixer to obtain a toner for electrostatic latent image development (7).

Production of Toner for Electrostatic Latent Image Development (8)

Aggregation Step

| | |
|---|---|
| Resin particle dispersion (4) | 250 parts |
| Coloring agent dispersion (1) | 40 parts |
| Releasing agent particle dispersion (1) | 100 parts |
| Ion-exchanged water | 920 parts |
| Aluminum sulfate (manufactured by Wako Pure Chemical Industries, Ltd.) | 6.5 parts |

After the above-mentioned components are all put in a round type flask made of a stainless steel and dispersed by a homogenizer (trade name: ULTRA-TURRAX T 50, manufactured by IKA Japan K.K.), the mixture in the flask is adjusted at pH 2.6 and heated to 49° C. in a heating oil bath under stirring condition. After the product being kept at 49° C. for 30 minutes, observation of the product by an optical microscope is carried out to find that flocculated particles with an average particle size of about 4.9 μm are formed. The resin particle dispersion (4) 125 parts is gently added to the obtained flocculate particle dispersion and further heated and stirred at 49° C. for 60 minutes while pH being kept at 2.6 and then observation of the product by an optical microscope is carried out to find that flocculated particles with an average particle size of about 5.5 μm are formed.

Coalescence Step

The obtained flocculate particle dispersion has pH 2.7. An aqueous solution containing 0.5% by weight of sodium hydroxide (manufactured by Wako Pure Chemical Industries, Ltd.) is slowly added to adjust the pH to be 4.1, the dispersion is heated to 96° C. while being continuously stirred and kept for 5 hours. After that, the obtained content in the flask is adjusted at pH about 7, the reaction product is filtered and washed four times with ion-exchanged water 500 parts and then dried by a vacuum drier to obtain a toner particle (8).

The obtained toner particle (8) has a volume average particle size of 5.7 μm, a shape factor SF1 of 141, Mw 62,000, and Mw/Mn 5.6. The storage elasticity at 180° C. [G'(180)] is found to be $6.2\times10^3$ Pa.

Hydrophobic titanium oxide (trade name: T805, average particle size: 0.021 μm, manufactured by Nippon Aerosil Co., Ltd.) 2 parts and hydrophobic silica (trade name: RX 50, average particle size: 0.040 μm, manufactured by Nippon Aerosil Co., Ltd.) 10 parts are extrapolated to the obtained toner particle (8) 100 parts and mixed by a Henshel mixer to obtain a toner for electrostatic latent image development (8).

Production of Toner for Electrostatic Latent Image Development (9)

Aggregation Step

| | |
|---|---|
| Resin particle dispersion (1) | 100 parts |
| Resin particle dispersion (2) | 50 parts |
| Coloring agent dispersion (1) | 40 parts |
| Releasing agent particle dispersion (1) | 225 parts |
| Ion-exchanged water | 920 parts |
| Aluminum sulfate (manufactured by Wako Pure Chemical Industries, Ltd.) | 6.0 parts |

After the above-mentioned components are all put in a round type flask made of a stainless steel and dispersed by a homogenizer (trade name: ULTRA-TURRAX T 50, manufactured by IKA Japan K.K.), the mixture in the flask is adjusted at pH 2.6 and heated to 49° C. in a heating oil bath under stirring condition. After the product being kept at 49° C. for 30 minutes, observation of the product by an optical microscope is carried out to find that flocculated particles with an average particle size of about 5.2 μm are formed. The resin particle dispersion (1) 50 parts is gently added to the obtained flocculate particle dispersion and further heated and stirred at 49° C. for 60 minutes while pH being kept at 2.6 and then observation of the product by an optical microscope is carried out to find that flocculated particles with an average particle size of about 5.9 μm are formed.

Coalescence Step

The obtained flocculate particle dispersion has pH 2.7. An aqueous solution containing 0.5% by weight of sodium hydroxide (manufactured by Wako Pure Chemical Industries, Ltd.) is slowly added to adjust the pH to be 4.2, the dispersion is heated to 96° C. while being continuously stirred and kept for 8 hours. After that, the obtained content in the flask is adjusted at pH about 7, the reaction product is filtered and washed four times with ion-exchanged water 500 parts and then dried by a vacuum drier to obtain a toner particle (9).

The obtained toner particle (9) has a volume average particle size of 6.7 μm, a shape factor SF1 of 142, Mw 171,000, and Mw/Mn 5.3. The storage elasticity at 180° C. [G'(180)] is found to be $7.1\times10^3$ Pa.

Hydrophobic titanium oxide (trade name: T805, average particle size: 0.021 μm, manufactured by Nippon Aerosil Co., Ltd.) 2 parts and hydrophobic silica (trade name: RX 50, average particle size: 0.040 μm, manufactured by Nippon Aerosil Co., Ltd.) 10 parts are extrapolated to the obtained toner particle (9) 100 parts and mixed by a Henshel mixer to obtain a toner for electrostatic latent image development (9).

Production of Toner for Electrostatic Latent Image Development (10)

Aggregation Step

| | |
|---|---|
| Resin particle dispersion (1) | 310 parts |
| Resin particle dispersion (2) | 100 parts |
| Coloring agent dispersion (1) | 40 parts |
| Releasing agent particle dispersion (1) | 2.5 parts |
| Ion-exchanged water | 920 parts |
| Aluminum sulfate (manufactured by Wako Pure Chemical Industries, Ltd.) | 5.0 parts |

After the above-mentioned components are all put in a round type flask made of a stainless steel and dispersed by a homogenizer (trade name: ULTRA-TURRAX T 50, manufactured by IKA Japan K.K.), the mixture in the flask is adjusted at pH 2.6 and heated to 49° C. in a heating oil bath under stirring condition. After the product being kept at 49° C. for 30 minutes, observation of the product by an optical microscope is carried out to find that flocculated particles with an average particle size of about 4.8 μm are formed. The resin particle dispersion (1) 125 parts is gently added to the obtained flocculate particle dispersion and further heated and stirred at 49° C. for 30 minutes while pH being kept at 2.6 and then observation of the product by an optical microscope is carried out to find that flocculated particles with an average particle size of about 5.5 μm are formed.

Coalescence Step

The obtained flocculate particle dispersion has pH 2.7. An aqueous solution containing 0.5% by weight of sodium hydroxide (manufactured by Wako Pure Chemical Industries, Ltd.) is slowly added to adjust the pH to be 4.2, the dispersion is heated to 96° C. while being continuously stirred and kept for 5 hours. After that, the obtained content in the flask is adjusted at pH about 7, the reaction product is filtered and washed four times with ion-exchanged water 500 parts and then dried by a vacuum drier to obtain a toner particle (10).

The obtained toner particle (10) has a volume average particle size of 5.7 μm, a shape factor SF1 of 126, Mw 172,000, and Mw/Mn 5.3. The storage elasticity at 180° C. [G'(180)] is found to be $2.2\times10^3$ Pa.

Hydrophobic titanium oxide (trade name: T805, average particle size: 0.021 μm, manufactured by Nippon Aerosil Co., Ltd.) 2 parts and hydrophobic silica (trade name: RX 50, average particle size: 0.040 μm, manufactured by Nippon Aerosil Co., Ltd.) 10 parts are extrapolated to the obtained toner particle (10) 100 parts and mixed by a Henshel mixer to obtain a toner for electrostatic latent image development (10).

Production of Toner for Electrostatic Latent Image Development (11)

Aggregation Step

| | |
|---|---|
| Resin particle dispersion (1) | 150 parts |
| Resin particle dispersion (2) | 100 parts |
| Coloring agent dispersion (1) | 40 parts |
| Ion-exchanged water | 920 parts |
| Aluminum sulfate (manufactured by Wako Pure Chemical Industries, Ltd.) | 6.0 parts |
| Releasing agent emulsion (melting point = 110° C., manufactured by Mitsui Chemicals, Inc.) | 100 parts |

After the above-mentioned components are all put in a round type flask made of a stainless steel and dispersed by a homogenizer (trade name: ULTRA-TURRAX T 50, manufactured by IKA Japan K.K.), the mixture in the flask is adjusted at pH 2.6 and heated to 49° C. in a heating oil bath under stirring condition. After the product being kept at 49° C. for 30 minutes, observation of the product by an optical microscope is carried out to find that flocculated particles with an average particle size of about 4.9 μm are formed. The resin particle dispersion (4) 125 parts is gently added to the obtained flocculate particle dispersion and further heated and stirred at 49° C. for 60 minutes while pH being kept at 2.6 and then observation of the product by an optical microscope is carried out to find that flocculated particles with an average particle size of about 5.4 μm are formed.

Coalescence Step

The obtained flocculate particle dispersion has pH 2.7. An aqueous solution containing 0.5% by weight of sodium hydroxide (manufactured by Wako Pure Chemical Industries, Ltd.) is slowly added to adjust the pH to be 4.8, the dispersion is heated to 96° C. while being continuously stirred and kept for 5 hours. After that, the obtained content in the flask is adjusted at pH about 7, the reaction product is filtered and washed four times with ion-exchanged water 500 parts and then dried by a vacuum drier to obtain a toner particle (11).

The obtained toner particle (11) has a volume average particle size of 5.6 μm, a shape factor SF1 of 142, Mw 172,000, and Mw/Mn 5.4. The storage elasticity at 180° C. [G'(180)] is found to be $6.6\times10^3$ Pa.

Hydrophobic titanium oxide (trade name: T805, average particle size: 0.021 μm, manufactured by Nippon Aerosil Co., Ltd.) 2 parts and hydrophobic silica (trade name: RX 50, average particle size: 0.040 μm, manufactured by Nippon Aerosil Co., Ltd.) 10 parts are extrapolated to the obtained toner particle (11) 100 parts and mixed by a Henshel mixer to obtain a toner for electrostatic latent image development (11).

Production of Toner for Electrostatic Latent Image Development (12)

Aggregation Step

| | |
|---|---|
| Resin particle dispersion (1) | 150 parts |
| Resin particle dispersion (2) | 100 parts |
| Coloring agent dispersion (1) | 40 parts |
| Releasing agent particle dispersion (3) | 100 parts |
| Ion-exchanged water | 920 parts |
| Aluminum sulfate (manufactured by Wako Pure Chemical Industries, Ltd.) | 5.0 parts |

After the above-mentioned components are all put in a round type flask made of a stainless steel and dispersed by a homogenizer (trade name: ULTRA-TURRAX T 50, manufactured by IKA Japan K.K.), the mixture in the flask is adjusted at pH 2.6 and heated to 49° C. in a heating oil bath under stirring condition. After the product being kept at 49° C. for 30 minutes, observation of the product by an optical microscope is carried out to find that flocculated particles with an average particle size of about 7.0 μm are formed. The resin particle dispersion (1) 125 parts is gently added to the obtained flocculate particle dispersion and further heated and stirred at 49° C. for 40 minutes while pH being kept at 2.6 and then observation of the product by an optical microscope is carried out to find that flocculated particles with an average particle size of about 7.6 μm are formed.

Coalescence Step

The obtained flocculate particle dispersion has pH 2.7. An aqueous solution containing 0.5% by weight of sodium hydroxide (manufactured by Wako PureChemical Industries, Ltd.) is slowly added to adjust the pH to be 4.8, the dispersion is heated to 96° C. while being continuously stirred and kept for 6 hours. After that, the obtained content in the flask is adjusted at pH about 7, the reaction product is filtered and washed four times with ion-exchanged water 500 parts and then dried by a vacuum drier to obtain a toner particle (12).

The obtained toner particle (12) has a volume average particle size of 8.6 μm, a shape factor SF1 of 131, Mw 170,000, and Mw/Mn 5.3. The storage elasticity at 180° C. [G'(180)] is found to be $3.0\times10^3$ Pa.

Hydrophobic titanium oxide (trade name: T805, average particle size: 0.021 μm, manufactured by Nippon Aerosil Co., Ltd.) 2 parts and hydrophobic silica (trade name: RX 50, average particle size: 0.040 μm, manufactured by Nippon Aerosil Co., Ltd.) 10 parts are extrapolated to the obtained toner particle (12) 100 parts and mixed by a Henshel mixer to obtain a toner for electrostatic latent image development (12).

Production of Toner for Electrostatic Latent Image Development (13)

Aggregation Step

| | |
|---|---|
| Resin particle dispersion (1) | 150 parts |
| Resin particle dispersion (2) | 100 parts |
| Coloring agent dispersion (1) | 40 parts |
| Releasing agent particle dispersion (1) | 100 parts |
| Ion-exchanged water | 920 parts |
| Aluminum sulfate (manufactured by Wako Pure Chemical Industries, Ltd.) | 8.2 parts |

After the above-mentioned components are all put in a round type flask made of a stainless steel and dispersed by a homogenizer (trade name: ULTRA-TURRAX T 50, manufactured by IKA Japan K.K.), the mixture in the flask is adjusted at pH 2.5 and heated to 53° C. in a heating oil bath under stirring condition. After the product being kept at 53° C. for 40 minutes, observation of the product by an optical microscope is carried out to find that flocculated particles with an average particle size of about 9.5 μm are formed. The resin particle dispersion (1) 125 parts is gently added to the obtained flocculate particle dispersion and further heated and stirred at 53° C. for 90 minutes while pH being kept at 2.5 and then observation of the product by an optical microscope is carried out to find that flocculated particles with an average particle size of about 10.6 μm are formed.

Coalescence Step

The obtained flocculate particle dispersion has pH 2.5. An aqueous solution containing 0.5% by weight of sodium hydroxide (manufactured by Wako Pure Chemical Industries, Ltd.) is slowly added to adjust the pH to be 4.5, the dispersion is heated to 96° C. while being continuously stirred and kept for 6 hours. After that, the obtained content in the flask is adjusted at pH about 7, the reaction product is filtered and washed four times with ion-exchanged water 500 parts and then dried by a vacuum drier to obtain a toner particle (13).

The obtained toner particle (13) has a volume average particle size of 11.1 μm, a shape factor SF1 of 131, Mw 171,000, and Mw/Mn 5.3. The storage elasticity at 180° C. [G'(180)] is found to be $6.7\times10^3$ Pa.

Hydrophobic titanium oxide (trade name: T805, average particle size: 0.021 μm, manufactured by Nippon Aerosil Co., Ltd.) 1 parts and hydrophobic silica (trade name: RX 50, average particle size: 0.040 μm, manufactured by Nippon Aerosil Co., Ltd.) 5.1 parts are extrapolated to the obtained toner particle (13) 100 parts and mixed by a Henshel mixer to obtain a toner for electrostatic latent image development (13).

Production of Toner for Electrostatic Latent Image Development (14)

Aggregation Step

| | |
|---|---|
| Resin particle dispersion (1) | 150 parts |
| Resin particle dispersion (2) | 100 parts |
| Coloring agent dispersion (1) | 40 parts |
| Releasing agent particle dispersion (1) | 100 parts |
| Ion-exchanged water | 920 parts |
| Aluminum sulfate (manufactured by Wako Pure Chemical Industries, Ltd.) | 3.0 parts |

After the above-mentioned components are all put in a round type flask made of a stainless steel and dispersed by a homogenizer (trade name: ULTRA-TURRAX T 50, manufactured by IKA Japan K.K.), the mixture in the flask is adjusted at pH 2.8 and heated to 36° C. in a heating oil bath under stirring condition. After the product being kept at 36° C. for 60 minutes, observation of the product by an optical microscope is carried out to find that flocculated particles with an average particle size of about 3.0 μm are formed. The resin particle dispersion (1) 125 parts is gently added to the obtained flocculate particle dispersion and further heated and stirred at 36° C. for 120 minutes while pH being kept at 2.8 and then observation of the product by an optical microscope is carried out to find that flocculated particles with an average particle size of about 3.2 μm are formed.

Coalescence Step

The obtained flocculate particle dispersion has pH 2.8. An aqueous solution containing 0.5% by weight of sodium hydroxide (manufactured by Wako Pure Chemical Industries, Ltd.) is slowly added to adjust the pH to be 6.5, the dispersion is heated to 96° C. while being continuously stirred and kept for 8 hours. After that, the obtained content in the flask is adjusted at pH about 7, the reaction product is filtered and washed four times with ion-exchanged water 500 parts and then dried by a vacuum drier to obtain a toner particle (14).

The obtained toner particle (14) has a volume average particle size of 3.5 μm, a shape factor SF1 of 127, Mw 170,000, and Mw/Mn 5.3. The storage elasticity at 180° C. [G'(180)] is found to be $2.4\times10^3$ Pa.

Hydrophobic titanium oxide (trade name: T805, average particle size: 0.021 μm, manufactured by Nippon Aerosil Co., Ltd.) 3.3 parts and hydrophobic silica (trade name: RX 50, average particle size: 0.040 μm, manufactured by Nippon Aerosil Co., Ltd.) 16.3 parts are extrapolated to the obtained toner particle (14) 100 parts and mixed by a Henshel mixer to obtain a toner for electrostatic latent image development (14).

Production of Toner for Electrostatic Latent Image Development (15)

Aggregation Step

| | |
|---|---|
| Resin particle dispersion (5) | 150 parts |
| Resin particle dispersion (2) | 100 parts |
| Coloring agent dispersion (1) | 40 parts |
| Releasing agent particle dispersion (1) | 100 parts |
| Ion-exchanged water | 920 parts |
| Aluminum sulfate (manufactured by Wako Pure Chemical Industries, Ltd.) | 6.5 parts |

After the above-mentioned components are all put in a round type flask made of a stainless steel and dispersed by a homogenizer (trade name: ULTRA-TURRAX T 50, manufactured by IKA Japan K.K.), the mixture in the flask is adjusted at pH 2.6 and heated to 49° C. in a heating oil bath under stirring condition. After the product being kept at 49° C. for 30 minutes, observation of the product by an optical microscope is carried out to find that flocculated particles with an average particle size of about 5.8 μm are formed. The resin particle dispersion (1) 125 parts is gently added to the obtained flocculate particle dispersion and further heated and stirred at 49° C. for 60 minutes while pH being kept at 2.6 and then observation of the product by an optical microscope is carried out to find that flocculated particles with an average particle size of about 6.3 μm are formed.

Coalescence step

The obtained flocculate particle dispersion has pH 2.7. An aqueous solution containing 0.5% by weight of sodium hydroxide (manufactured by Wako Pure Chemical Industries, Ltd.) is slowly added to adjust the pH to be 4.8, the dispersion is heated to 96° C. while being continuously stirred and kept for 6 hours. After that, the obtained content in the flask is adjusted at pH about 7, the reaction product is filtered and washed four times with ion-exchanged water 500 parts and then dried by a vacuum drier to obtain a toner particle (15).

The obtained toner particle (15) has a volume average particle size of 6.6 μm, a shape factor SF1 of 135, Mw 169,000, and Mw/Mn 5.3. The storage elasticity at 180° C. [G'(180)] is found to be $5.7\times10^3$ Pa.

Hydrophobic titanium oxide (trade name: T805, average particle size: 0.021 μm, manufactured by Nippon Aerosil Co., Ltd.) 2 parts and hydrophobic silica (trade name: RX 50, average particle size: 0.040 μm, manufactured by Nippon Aerosil Co., Ltd.) 10 parts are extrapolated to the obtained toner particle (15) 100 parts and mixed by a Henshel mixer to obtain a toner for electrostatic latent image development (15).

Production of Toner for Electrostatic Latent Image Development (16)

Aggregation Step

| | |
|---|---|
| Resin particle dispersion (1) | 125 parts |
| Resin particle dispersion (2) | 175 parts |
| Coloring agent dispersion (1) | 40 parts |
| Releasing agent particle dispersion (1) | 100 parts |
| Ion-exchanged water | 920 parts |
| Aluminum sulfate (manufactured by Wako Pure Chemical Industries, Ltd.) | 9.0 parts |

After the above-mentioned components are all put in a round type flask made of a stainless steel and dispersed by a homogenizer (trade name: ULTRA-TURRAX T 50, manufactured by IKA Japan K.K.), the mixture in the flask is adjusted at pH 2.6 and heated to 55° C. in a heating oil bath under stirring condition. After the product being kept at 55° C. for 30 minutes, observation of the product by an optical microscope is carried out to find that flocculated particles with an average particle size of about 9.5 μm are formed. The resin particle dispersion (1) 75 parts is gently added to the obtained flocculate particle dispersion and further heated and stirred at 55° C. for 60 minutes while pH being kept at 2.6 and then observation of the product by an optical microscope is carried out to find that flocculated particles with an average particle size of about 10.2 μm are formed.

Coalescence Step

The obtained flocculate particle dispersion has pH 2.7. An aqueous solution containing 0.5% by weight of sodium hydroxide (manufactured by Wako Pure Chemical Industries, Ltd.) is slowly added to adjust the pH to be 4.2, the dispersion is heated to 96° C. while being continuously stirred and kept for 10 hours. After that, the obtained content in the flask is adjusted at pH about 7, the reaction product is filtered and washed four times with ion-exchanged water 500 parts and then dried by a vacuum drier to obtain a toner particle (16).

The obtained toner particle (16) has a volume average particle size of 10.6 μm, a shape factor SF1 of 150, Mw 366,000, and Mw/Mn 5.9. The storage elasticity at 180° C. [G'(180)] is found to be $1.2\times10^4$ Pa.

Hydrophobic titanium oxide (trade name: T805, average particle size: 0.021 μm, manufactured by Nippon Aerosil Co., Ltd.) 1.1 parts and hydrophobic silica (trade name: RX 50, average particle size: 0.040 μm, manufactured by Nippon Aerosil Co., Ltd.) 5.4 parts are extrapolated to the obtained toner particle (16) 100 parts and mixed by a Henshel mixer to obtain a toner for electrostatic latent image development (16).

Production of Toner for Electrostatic Latent Image Development (17)

Aggregation Step

| | |
|---|---|
| Resin particle dispersion (1) | 240 parts |
| Resin particle dispersion (2) | 10 parts |
| Coloring agent dispersion (1) | 40 parts |
| Releasing agent particle dispersion (2) | 100 parts |
| Ion-exchanged water | 920 parts |
| Aluminum sulfate (manufactured by Wako Pure Chemical Industries, Ltd.) | 5.0 parts |

After the above-mentioned components are all put in a round type flask made of a stainless steel and dispersed by a homogenizer (trade name: ULTRA-TURRAX T 50, manufactured by IKA Japan K.K.) , the mixture in the flask is adjusted at pH 2.6 and heated to 49° C. in a heating oil bath under stirring condition. After the product being kept at 49° C. for 30 minutes, observation of the product by an optical microscope is carried out to find that flocculated particles with an average particle size of about 5.0 μm are formed. The resin particle dispersion (1) 125 parts is gently added to the obtained flocculate particle dispersion and further heated and stirred at 49° C. for 60 minutes while pH being kept at 2.6 and then observation of the product by an optical microscope is carried out to find that flocculated particles with an average particle size of about 5.5 μm are formed.

Coalescence Step

The obtained flocculate particle dispersion has pH 2.6. An aqueous solution containing 0.5% by weight of sodium hydroxide (manufactured by Wako Pure Chemical Industries, Ltd.) is slowly added to adjust the pH to be 5.0, the dispersion is heated to 96° C. while being continuously stirred and kept for 5 hours. After that, the obtained content in the flask is adjusted at pH about 7, the reaction product is filtered and washed four times with ion-exchanged water 500 parts and then dried by a vacuum drier to obtain a toner particle (17).

The obtained toner particle (17) has a volume average particle size of 5.8 μm, a shape factor SF1 of 118, Mw 46,000, and Mw/Mn 3.5. The storage elasticity at 180° C. [G'(180)] is found to be $9.0\times10^2$ Pa.

Hydrophobic titanium oxide (trade name: T805, average particle size: 0.021 μm, manufactured by Nippon Aerosil Co., Ltd.) 2 parts and hydrophobic silica (trade name: RX 50, average particle size: 0.040 μm, manufactured by Nippon Aerosil Co., Ltd.) 10 parts are extrapolated to the obtained toner particle (17) 100 parts and mixed by a Henshel mixer to obtain a toner for electrostatic latent image development (17).

Production of Toner for Electrostatic Latent Image Development (18)

Styrene-acrylic resin (Mw: 32,00, manufactured by Soken Chemical & Engineering Co., Ltd.) 40 parts is mixed with carbon black (trade name: REGAL 330, manufactured by Cabot Corporation) 30 parts and carnauba wax 30 parts and melted and kneaded by a pressurizing type kneader to produce a resin mixture 1.

| | |
|---|---|
| Styrene | 140 parts |
| n-Butyl acrylate | 50 parts |
| Stearyl acrylate | 10 parts |
| Tert-laurylmercaptan | 1.0 part |
| Hexanediol diacrylate | 3.0 parts |
| 2,2'-azobis-2-methylvaleronitrile | 1.0 part |
| (all manufactured by Wako Pure Chemical Industries, Ltd.) | |
| Resin mixture 1 | 50.0 parts |

After the above-mentioned components are all melted, they are added to a water-based medium obtained by dispersing calcium carbonate 25 parts in ion-exchanged water 500 parts and dispersed by a homogenizer (trade name: ULTRA-TURRAX T 50, manufactured by IKA Japan K.K.) and then observation of the obtained dispersion by an optical microscope is carried out to find that there exist oil droplets with an average particle size of about 7.6 μm in the inside. The dispersion system heated to 80° C. under nitrogen flow and kept as it is for 5 hours to obtain suspended polymer particles. After cooling, 1N hydrochloric acid (manufactured by Wako Pure Chemical Industries, Ltd.) is dropwise added to adjust pH at 2.2 and the system is kept still for 1 hour. After that, the pH of the product in a container is adjusted at pH about 7 and the reaction product is filtered and washed four times with ion-exchanged water 500 parts and then dried by a vacuum drier to obtain a toner particle (18).

The obtained toner particle (18) has a volume average particle size of 7.7 μm, a shape factor SF1 of 138, Mw 143,000, and Mw/Mn 7.1. The storage elasticity at 180° C. [G'(180)] is found to be $5.8\times10^3$ Pa.

Hydrophobic titanium oxide (trade name: T805, average particle size: 0.021 μm, manufactured by Nippon Aerosil Co., Ltd.) 2 parts and hydrophobic silica (trade name: RX 50, average particle size: 0.040 μm, manufactured by Nippon Aerosil Co., Ltd.) 10 parts are extrapolated to the obtained toner particle (18) 100 parts and mixed by a Henshel mixer to obtain a toner for electrostatic latent image development (18). Production of toners for electrostatic latent image development Together with toluene 400 parts, a ferrite particle (volume average particle size: 50 μm; manufactured by POWDERTECH CORP.) 100 parts and a silicone resin (trade name: SR2411, manufactured by Dow Corning Toray Silicone Co., Ltd.) 3.0 parts are put in a pressurizing type kneader and stirred and mixed at a normal temperature for 15 minutes and heated to 70° C. while being mixed in reduced pressure to remove toluene and further stirred and mixed at 180° C. for 2 hours. After that, being cooled, the mixture is sieved by a sieve having 105 μm mesh to obtain a ferrite carrier (resin-coated carrier).

The ferrite carrier and the respective toners for electrostatic latent image development (1) to (18) are mixed to obtain two-component type electrostatic latent image developers (1) to (18) with a toner concentration of 7% by weight, respectively.

Example 1

Image evaluation is carried out using a copying machine (trade name: MODIFIED VIVACE 555 model as an evaluation apparatus, fusing temperature set at 180° C.; manufactured by Fuji Xerox Co., Ltd.); the fusing roll (1) disposed as a fusing roll; and the electrostatic latent image developer (1) as a developer.

The evaluation is carried out as follows: image formation is carried out while the image concentration being adjusted so as to control the toner transfer quantity to the recording medium surface to be 4.5 g/m$^2$; S paper and J paper manufactured by Fuji Xerox Co., Ltd. are used as the paper (recording media); summer environments (30° C./85% RH) and winter environments (10° C./15% RH) are repeated for every 2,000 sheets; the contact angle of the fusing roll to water at 25° C. is measured at every 10,000 sheets and peeling property of the fusing roll from paper, occurrence of off-set, and other image defects are evaluated. Copying is repeated for 30,000 sheets.

Together with the respective data of the above-mentioned [G'(180)] of the toner used in the Example, the releasing agent amount, the releasing agent melting point, the toner volume average particle size, and the contact angle of the fusing roll to water at 25° C., the results are shown in Tables 1 and 2.

Example 2

The copying test is carried out in the same manner as that in Example 1 and same evaluation is carried out except that the electrostatic latent image developer (2) is used in place of the electrostatic latent image developer (1).

The results are shown in Tables 1 and 2.

Example 3

The copying test is carried out in the same manner as that in Example 1 and same evaluation is carried out except that the electrostatic latent image developer (3) is used in place of the electrostatic latent image developer (1).

The results are shown in Tables 1 and 2.

Example 4

The copying test is carried out in the same manner as that in Example 1 and same evaluation is carried out except that the electrostatic latent image developer (4) is used in place of the electrostatic latent image developer (1).

The results are shown in Tables 1 and 2.

Example 5

The copying test is carried out in the same manner as that in Example 1 and same evaluation is carried out except that the fusing roll (2) is used in place of the fusing roll (1).

The results are shown in Tables 1 and 2.

Example 6

The copying test is carried out in the same manner as that in Example 1 and same evaluation is carried out except that the fusing roll (3) is used in place of the fusing roll (1).

The results are shown in Tables 1 and 2.

Example 7

The copying test is carried out in the same manner as that in Example 1 and same evaluation is carried out except that the electrostatic latent image developer (5) is used in place of the electrostatic latent image developer (1).

The results are shown in Tables 1 and 2.

Example 8

The copying test is carried out in the same manner as that in Example 1 and same evaluation is carried out except that the electrostatic latent image developer (6) is used in place of the electrostatic latent image developer (1).

The results are shown in Tables 1 and 2.

Example 9

The copying test is carried out in the same manner as that in Example 1 and same evaluation is carried out except that the electrostatic latent image developer (7) is used in place of the electrostatic latent image developer (1).

The results are shown in Tables 1 and 2.

Example 10

The copying test is carried out in the same manner as that in Example 1 and same evaluation is carried out except that the electrostatic latent image developer (8) is used in place of the electrostatic latent image developer (1).

The results are shown in Tables 1 and 2.

Example 11

The copying test is carried out in the same manner as that in Example 1 and same evaluation is carried out except that the electrostatic latent image developer (9) is used in place of the electrostatic latent image developer (1).

The results are shown in Tables 1 and 2.

Example 12

The copying test is carried out in the same manner as that in Example 1 and same evaluation is carried out except that the electrostatic latent image developer (10) is used in place of the electrostatic latent image developer (1).

The results are shown in Tables 1 and 2.

Example 13

The copying test is carried out in the same manner as that in Example 1 and same evaluation is carried out except that the electrostatic latent image developer (11) is used in place of the electrostatic latent image developer (1).

The results are shown in Tables 1 and 2.

Example 14

The copying test is carried out in the same manner as that in Example 1 and same evaluation is carried out except that the electrostatic latent image developer (12) is used in place of the electrostatic latent image developer (1).

The results are shown in Tables 1 and 2.

Example 15

The copying test is carried out in the same manner as that in Example 1 and same evaluation is carried out except that the electrostatic latent image developer (18) is used in place of the electrostatic latent image developer (1).

The results are shown in Tables 1 and 2.

Example 16

The copying test is carried out in the same manner as that in Example 1 and same evaluation is carried out except that the electrostatic latent image developer (13) is used in place of the electrostatic latent image developer (1).

The results are shown in Tables 1 and 2.

Example 17

The copying test is carried out in the same manner as that in Example 1 and same evaluation is carried out except that the electrostatic latent image developer (14) is used in place of the electrostatic latent image developer (1).

The results are shown in Tables 1 and 2.

Example 18

The copying test is carried out in the same manner as that in Example 1 and same evaluation is carried out except that the electrostatic latent image developer (15) is used in place of the electrostatic latent image developer (1).

The results are shown in Tables 1 and 2.

Example 19

The copying test is carried out in the same manner as that in Example 1 and same evaluation is carried out except that the fusing roll (4) is used in place of the fusing roll (1).

The results are shown in Tables 1 and 2.

Comparative Example 1

The copying test is carried out in the same manner as that in Example 1 and same evaluation is carried out except that the electrostatic latent image developer (16) is used in place of the electrostatic latent image developer (1).

Comparative Example 2

The copying test is carried out in the same manner as that in Example 1 and same evaluation is carried out except that the electrostatic latent image developer (17 is used in place of the electrostatic latent image developer (1).

Comparative Example 3

The copying test is carried out in the same manner as that in Example 1 and same evaluation is carried out except that the fusing roll (5) is used in place of the fusing roll (1).

Comparative Example 4

The copying test is carried out in the same manner as that in Example 1 and same evaluation is carried out except that the fusing roll (6) is used in place of the fusing roll (1).

Comparative Example 5

The copying test is carried out in the same manner as that in Example 1 and same evaluation is carried out except that the fusing roll (7) is used in place of the fusing roll (1).

Comparative Example 6

The copying test is carried out in the same manner as that in Example 1 and same evaluation is carried out except that the fusing roll (8) is used in place of the fusing roll (1).

The results of comparative examples 1 to 6 are also shown in Tables 1 and 2.

| | G' (180) | Releasing agent | Releasing agent | Toner average | Contact angle (°) to water at 25° C. | | | |
|---|---|---|---|---|---|---|---|---|
| | ($\times 10^3$ Pa) | amt. (parts) | melting point (° C.) | particle size ($\mu$m) | At starting | 10,000th sheet | 20,000th sheet | 30,000th sheet |
| Example 1 | 5.5 | 20 | 75 | 5.7 | 76 | 75 | 72 | 68 |
| Example 2 | 6.1 | 20 | 75 | 6.0 | 76 | 74 | 70 | 67 |
| Example 3 | 3.2 | 20 | 75 | 5.9 | 76 | 76 | 72 | 68 |
| Example 4 | 4.2 | 20 | 75 | 5.7 | 76 | 75 | 71 | 67 |
| Example 5 | 5.5 | 20 | 75 | 5.7 | 94 | 90 | 80 | 65 |
| Example 6 | 5.5 | 20 | 75 | 5.7 | 60 | 55 | 51 | 48 |
| Example 7 | 7.7 | 20 | 75 | 8.0 | 76 | 71 | 61 | 52 |
| Example 8 | 1.5 | 20 | 75 | 7.4 | 76 | 74 | 70 | 62 |
| Example 9 | 4.5 | 20 | 75 | 5.7 | 76 | 72 | 70 | 66 |
| Example 10 | 6.2 | 20 | 75 | 5.7 | 76 | 74 | 71 | 69 |
| Example 11 | 7.1 | 45 | 75 | 6.7 | 76 | 76 | 74 | 71 |
| Example 12 | 2.2 | 0.5 | 75 | 4.6 | 76 | 73 | 69 | 65 |
| Example 13 | 6.6 | 25 | 110 | 5.1 | 76 | 72 | 65 | 57 |
| Example 14 | 3.0 | 15 | 38 | 8.6 | 76 | 75 | 71 | 68 |
| Example 15 | 5.8 | 27 | 86 | 7.7 | 76 | 70 | 62 | 54 |
| Example 16 | 6.7 | 20 | 75 | 11.1 | 76 | 73 | 69 | 65 |
| Example 17 | 2.4 | 20 | 75 | 3.5 | 76 | 74 | 68 | 63 |
| Example 18 | 5.7 | 30 | 75 | 6.6 | 76 | 75 | 71 | 68 |
| Example 19 | 5.5 | 20 | 75 | 5.7 | 90 | 88 | 86 | 82 |
| Comparative Example 1 | 12.1 | 20 | 75 | 10.5 | 76 | 56 | 37 | 30 |
| Comparative Example 2 | 0.9 | 20 | 75 | 5.8 | 76 | 60 | 47 | 35 |
| Comparative Example 3 | 5.5 | 20 | 75 | 5.7 | 110 | 80 | 51 | 36 |
| Comparative Example 4 | 5.5 | 20 | 75 | 5.7 | 116 | 90 | 67 | 40 |

-continued

| | G' (180) ($\times 10^3$ Pa) | Releasing agent amt. (parts) | Releasing agent melting point (° C.) | Toner average particle size (μm) | Contact angle (°) to water at 25° C. At starting | 10,000th sheet | 20,000th sheet | 30,000th sheet |
|---|---|---|---|---|---|---|---|---|
| Comparative Example 5 | 5.5 | 20 | 75 | 5.7 | 40 | 33 | 29 | 25 |
| Comparative Example 6 | 5.5 | 20 | 75 | 5.7 | 42 | 40 | 35 | 30 |

| | Off-set of fused image | | | | Peeling state from fusing roll | | | |
|---|---|---|---|---|---|---|---|---|
| | At starting | 10,000th sheet | 20,000th sheet | 30,000th sheet | At starting | 10,000th sheet | 20,000th sheet | 30,000th sheet |
| Example 1 | Null | Null | Null | Null | Good | Good | Good | Good |
| Example 2 | Null | Null | Null | Null | Good | Good | Good | Good |
| Example 3 | Null | Null | Null | Null | Good | Good | Good | Good |
| Example 4 | Null | Null | Null | Null | Good | Good | Good | Good |
| Example 5 | Null | Null | Null | Null | Good | Good | Good | Slightly deteriorated |
| Example 6 | Null | Null | Null | Slightly observed | Slightly deteriorated | Fairly deteriorated | Fairly deteriorated | Deteriorated |
| Example 7 | Null | Null | Null | Null | Good | Good | Slightly deteriorated | Fairly deteriorated |
| Example 8 | Null | Null | Null | Null | Good | Good | Good | Slightly deteriorated |
| Example 9 | Null | Null | Null | Null | Good | Good | Good | Good |
| Example 10 | Null | Null | Null | Null | Good | Good | Good | Good |
| Example 11 | Null | Null | Null | Null | Good | Good | Good | Good |
| Example 12 | Null | Null | Null | Null | Good | Good | Good | Slightly deteriorated |
| Example 13 | Null | Null | Null | Null | Good | Good | Slightly deteriorated | Fairly deteriorated |
| Example 14 | Null | Null | Null | Null | Good | Good | Good | Good |
| Example 15 | Null | Null | Null | Null | Good | Good | Slightly deteriorated | Fairly deteriorated |
| Example 16 | Null | Null | Null | Null | Good | Good | Good | Slightly deteriorated |
| Example 17 | Null | Null | Null | Null | Good | Good | Good | Slightly deteriorated |
| Example 18 | Null | Null | Null | Null | Good | Good | Good | Good |
| Example 19 | Null | Null | Null | Null | Good | Good | Good | Good |
| Comparative Example 1 | Null | Null | Observed | Observed | Good | Fairly deteriorated | Rolling taking place | Rolling taking place |
| Comparative Example 2 | Null | Slightly observed | Slightly observed | Observed | Slightly deteriorated | Slightly deteriorated | Deteriorated | Rolling taking place |
| Comparative Example 3 | Null | Null | Null | Observed | Good | Good | Fairly deteriorated | Rolling taking place |
| Comparative Example 4 | Null | Null | Null | Slightly observed | Good | Good | Good | Fairly deteriorated |
| Comparative Example 5 | Slightly observed | Observed | Observed | Observed | Good | Rolling taking place | Rolling taking place | Rolling taking place |
| Comparative Example 6 | Slightly observed | Slightly observed | Slightly observed | Slightly observed | Fairly deteriorated | Fairly deteriorated | Fairly deteriorated | Fairly deteriorated |

The results in Tables 1 and 2 make the following clear. That is, in the image forming method of the invention described in Examples, even if a material with high surface energy, which is used conventionally as a fusing roll coating, is not used, the peeling property of the roll from paper is made good and off-set is hardly caused by controlling the storage elasticity of a toner, the contact angle of the surface of a fusing roll (a heating medium) to water at 25° C. to be in predetermined ranges, respectively.

On the other hand, in Comparative Examples 1 and 2, in the case the storage elasticity of the toner is high (Comparative Example 1), although it is no problem at the starting, it is found that the resin in the fusing roll surface is worn supposedly attributed to the hardness of the toner and the extrapolated agents along with the increase of the number of copying sheets and in the case the storage elasticity is low (Comparative Example 2), off-set is observed supposedly attributed to adhesiveness of the toner to the fusing roll.

In Comparative Example 3, the silicone resin with a high contact angle to water, which is used for the fusing roll coating, exhibits no problem at the starting, however the resin on the fusing roll surface is peeled off and the fusing roll capability is quickly deteriorated attributed to wearing or the like. In the case of Comparative Example 4 with a low contact angle of the fusing roll surface, off-set takes place from the starting and that is supposedly attributed to the good adhesiveness between the toner and the fusing roll surface.

Further, as shown in Comparative Example 5, in the case stainless steel roll is used as it is for the fusing roll, off-set is fairly caused from the starting, however that is scarcely changed along with increase of the number of the copying sheets. That is supposedly attributed to the material change of the surface is scarce.

According to the invention, in electrophotographic process, adhesiveness of a toner to the fusing roll surface and the wear of the fusing roll surface can be suppressed at the time of fusing by controlling the contact angle of the fusing roll surface to water at 25° C. and the storage elasticity of the toner and accordingly the invention provides an image forming method free from peeling failure of paper and off-set and capable of maintaining an excellent fusing capability even if the number of copying sheets is increased.

What is claimed is:

1. An image forming method comprising the steps of:

forming an electrostatic latent image on a surface of an electrostatic latent image bearing body;

forming a toner image by developing the electrostatic latent image by using a toner for electrostatic latent image development;

transferring the toner image to a surface of a recording medium; and fusing the transferred toner image on the surface of the recording medium by bringing the toner image into contact with a heating medium having a resin coating layer formed on the surface thereof and thereby melting the toner image, wherein the toner for the electrostatic latent image development includes a binder resin obtained by polymerizing one or more polymerizable monomers having vinyl double bonds;

a storage elasticity G'(180) of the toner for electrostatic latent image development at 180° C. is in a range of $1\times10^3$ to $8\times10^3$ Pa;

a contact angle of the surface of the heating medium to water at 25° C. is in a range of 50 to 100°, and wherein the binder resin has a weight average molecular weight in a range of 150,000 to 500,000.

2. An image forming method according to the claim 1, wherein a resin included in the resin coating layer is a heat-curable resin.

3. An image forming method according to the claim 2, wherein the heat-curable resin includes at least one selected from the group consisting of phenol resin and melamine resin.

4. An image forming method according to the claim 1, wherein the contact angle of the surface of the heating medium to water at 25° C. is in a range of 70 to 100°.

5. An image forming method according to the claim 1, wherein the resin coating layer has a thickness in a range of 1 to 100 $\mu$m.

6. An image forming method according to the claim 1, wherein the toner for electrostatic latent image development contains external additives formed from single substances or mixtures having at least two different average particle sizes, wherein at least one of the external additives is a metal oxide having an average particle size of 0.03 $\mu$m or less.

7. An image forming method according to the claim 1, wherein the storage elasticity G'(180) is in a range of $3.0\times10^3$ to $8\times10^3$ Pa.

8. An image forming method according to the claim 1, wherein a ratio (Mw/Mn) of a weight average molecular weight Mw and a number average molecular weight Mn of the binder resin is in a range of 5 to 10.

9. An image forming method according to the claim 1, wherein the one or more polymerizable monomers having vinyl double bonds are comprised of polymerizable monomers having carboxyl groups.

10. An image forming method according to the claim 1, wherein the toner for electrostatic latent image development includes a releasing agent in an amount of 1 to 40% by weight of the toner and a melting point of the releasing agent is in a range of 40 to 100° C.

11. An image forming method according to the claim 1, wherein the storage elasticity G'(180) of the toner for electrostatic latent image development at 180° C. is in a range of $3\times10^3$ to $8\times10^3$ Pa, and wherein the contact angle of the surface of the heating medium to water at 25° C. is in a range of 70 to 100°.

* * * * *